United States Patent [19]

Barker et al.

[11] 4,432,064

[45] Feb. 14, 1984

[54] APPARATUS FOR MONITORING A PLURALITY OF OPERATIONS

[75] Inventors: Kenneth D. Barker, Duncan; Edward P. Arnold, Comanche, both of Okla.

[73] Assignee: Halliburton Company, Duncan, Okla.

[21] Appl. No.: 201,161

[22] Filed: Oct. 27, 1980

[51] Int. Cl.[3] ..... G06F 15/46; E21B 47/00; G01D 21/00

[52] U.S. Cl. ..... 364/550; 175/40; 364/132; 364/422

[58] Field of Search ..... 364/550, 551, 708, 900; 166/65, 66, 250; 175/40, 25; 73/151; 346/33 WL; 340/853-861; 367/25, 35

[56] References Cited

U.S. PATENT DOCUMENTS

| | | | |
|---|---|---|---|
| 3,042,258 | 7/1962 | Mayes | 222/26 |
| 3,068,796 | 12/1962 | Pfluger et al. | 137/8 |
| 3,081,910 | 3/1963 | Zedler, Jr. | 222/22 |
| 3,890,839 | 6/1975 | Trostmann et al. | 73/199 |
| 3,916,383 | 10/1975 | Malcolm | 364/200 |
| 3,949,207 | 4/1976 | Savary et al. | 364/510 |
| 3,991,611 | 11/1976 | Marshall et al. | 340/857 X |
| 3,999,686 | 12/1976 | Kato | 222/39 |
| 4,003,431 | 1/1977 | Novotny et al. | 166/250 |
| 4,012,712 | 3/1977 | Nelligan | 340/857 |
| 4,037,598 | 7/1977 | Georgi | 364/510 |
| 4,057,847 | 11/1977 | Lowell et al. | 364/200 |
| 4,111,272 | 9/1978 | Ricciardi et al. | 177/50 |
| 4,150,721 | 4/1979 | Norwood | 166/53 |
| 4,193,299 | 3/1980 | Holzem et al. | 73/199 |
| 4,216,536 | 8/1980 | More | 367/25 X |
| 4,251,858 | 2/1981 | Cambigue et al. | 364/132 |

FOREIGN PATENT DOCUMENTS

| | | | |
|---|---|---|---|
| 2743028 | 4/1978 | Fed. Rep. of Germany | 367/25 |

OTHER PUBLICATIONS

Benez et al.: SINAUT 8-FW- A Computerized Telecontrol System Siemens Power Engineering, Jul. 1979, pp. 228-231 in 364-132.

Kitanosono: Computer Control Systems, Hitachi Review, vol. 25, No. 6, Jun. 1976, pp. 205-212 in 364-131.

Korn: A Distributed Computer System for Laboratory Automation, Computer Design, vol. 16, No. 6, Jun. 1977, pp. 177-182, 364-551.

Foster (Kent Instruments): P-4000 A new integrated control system, Kent Technical Review, (G.B.), No. 25, Jul. 1979, pp. 3-11 in 364-131.

*Primary Examiner*—Felix D. Gruber

*Attorney, Agent, or Firm*—E. Harrison Gilbert, III; Joseph A. Walkowski; Thomas R. Weaver

[57] ABSTRACT

An apparatus for monitoring a plurality of operations, particularly on an offshore drilling rig, comprises a portable housing, a plurality of dedicated monitoring units associated with the housing, and a master microcomputer unit associated with the housing for handling information transfers between each of the dedicated monitoring units. Each monitoring unit includes a dedicated central processing unit which controls the operation of that unit. Control is maintained over a number of transducers which detect various physical conditions associated with the monitored operation. The electrical signals obtained from monitoring the conditions are processed and displayed on respective display consoles located in the housing. Intercommunication among the various units is achieved through serial input/output devices establishing communication channels between each unit and the master microcomputer unit.

20 Claims, 18 Drawing Figures

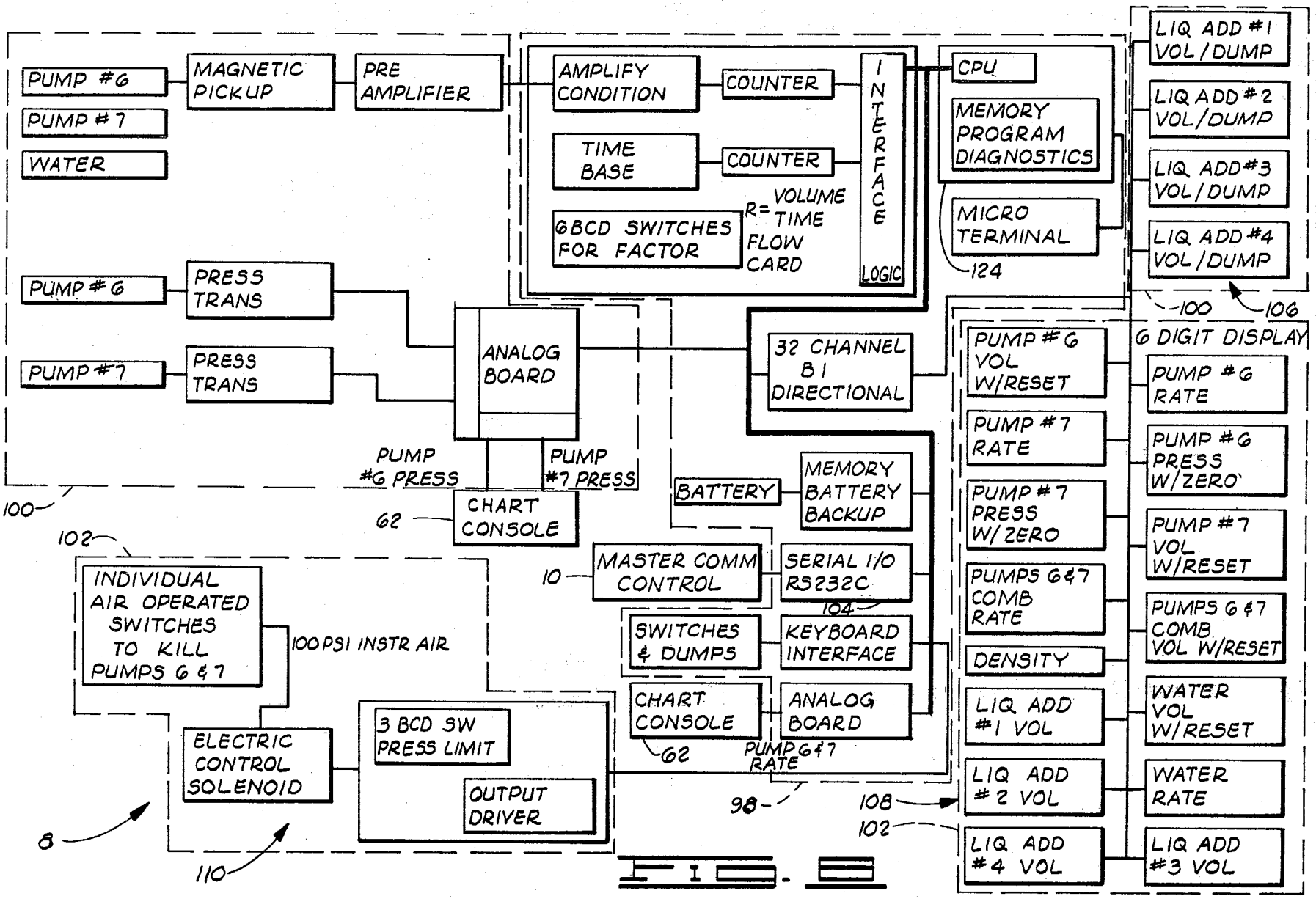
LIQ ADD #1 VOL/DUMP
LIQ ADD #2 VOL/DUMP
LIQ ADD #3 VOL/DUMP
LIQ ADD #4 VOL/DUMP
106
100
6 DIGIT DISPLAY
PUMP #6 RATE
PUMP #6 PRESS W/ZERO
PUMP #7 VOL W/RESET
PUMPS 6 & 7 COMB VOL W/RESET
WATER VOL W/RESET
WATER RATE
LIQ ADD #3 VOL
PUMP #6 VOL W/RESET
PUMP #7 RATE
PUMP #7 PRESS W/ZERO
PUMPS 6 & 7 COMB RATE
DENSITY
LIQ ADD #1 VOL
LIQ ADD #2 VOL
LIQ ADD #4 VOL
CPU
MEMORY PROGRAM DIAGNOSTICS
MICRO TERMINAL
124
INTERFACE LOGIC
COUNTER
COUNTER
VOLUME R= TIME FLOW CARD
AMPLIFY CONDITION
TIME BASE
6 BCD SWITCHES FOR FACTOR
32 CHANNEL BI DIRECTIONAL
MEMORY BATTERY BACKUP
SERIAL I/O RS232C
104
KEYBOARD INTERFACE
ANALOG BOARD
PUMP 6 & 7 RATE
108
102
BATTERY
MASTER COMM CONTROL
SWITCHES & DUMPS
CHART CONSOLE
62
98
10
ANALOG BOARD
PUMP #7 PRESS
CHART CONSOLE
PUMP #6 PRESS
62
PRE AMPLIFIER
MAGNETIC PICKUP
PRESS TRANS
PRESS TRANS
PUMP #6
PUMP #7
WATER
PUMP #6
PUMP #7
100
100 PSI INSTR AIR
3 BCD SW PRESS LIMIT
OUTPUT DRIVER
ELECTRIC CONTROL SOLENOID
INDIVIDUAL AIR OPERATED SWITCHES TO KILL PUMPS 6 & 7
102
110
8

APPARATUS FOR MONITORING A PLURALITY OF OPERATIONS

This invention relates generally to electronic monitoring systems and more particularly, but not by way of limitation, to microcomputer-based systems for monitoring a plurality of operations on an offshore drilling rig.

In monitoring a plurality of operations it is necessary to consider several factors so that an efficient system can be developed to perform the desired monitoring. The factors which must be considered include the quantity of information which must be processed to effectively monitor each operation, the physical location and allowable size of the monitoring equipment, the number of conditions associated with each operation, and the speed at which the equipment must operate to provide the desired output. These factors must be considered together because each often depends on the specific nature of another. For example, the greater the number of conditions there are to be monitored, the faster the system must operate to handle the information in the same time period in which a fewer number of conditions are processed by a slower system.

Specifically, on an offshore drilling rig the quantity of information to be processed is large because such operations as blending materials for obtaining fracturing and cementing fluids, pumping substances into a well, and cementing the well must be monitored. Because of this large quantity of information to be processed, some type of computer means should be utilized. However, because there is little space available at an offshore drilling rig, the computer means must be relatively small.

Although the computer means must be physically small, it must be capable of controlling the monitoring of the large number of conditions which are associated with such operations as the blending, pumping and cementing functions mentioned above. These conditions include flow rates of materials and pressures and temperatures associated with various operations. Because of the large number of conditions to be monitored, the computer means must operate at a sufficiently high speed.

So that human control can be exercised over the computer means, there is also the need for a communication terminal and means for interfacing the terminal with the computer means.

In addition to the preceding factors one must consider the environment in which the monitoring system is to be used. On offshore drilling rigs the atmosphere is dangerous because of the ambient flammable and explosive gases which accompany the drilling of a well. Furthermore, rough seas and strict governmental regulations must be considered in an offshore drilling environment. For example, drilling rigs located in the North Sea cannot use service boats for holding the operations monitoring equipment because the sea is often too rough and further because regulations, such as those promulgated by the Norwegian Petroleum Directorate, cannot be easily complied with by using service boats. Therefore, there is the need for a housing which can be placed on an offshore drilling platform and which protects the monitoring equipment to the extent dictated by government regulations and the ambient environment. In the particular environment of the North Sea under Norwegian jurisdiction, it is desirable to maintain the electronic equipment in a zone 1 environment (Zone 1 is the Norwegian classification which is the equivalent to the United States Division One, Class One, Group D Explosion-proof classification). This requires locating the controls in a housing which is purged with safe air to maintain a positive pressure therein so that no ignitable or detonable gases enter the housing.

Although the need for an apparatus for monitoring one or more operations occurring during the life of an oil or gas well has been recognized, as indicated by the process of cementing wells disclosed in U.S. Pat. No. 4,003,431 and the gas well controller system disclosed in U.S. Pat. No. 4,150,721, we do not believe that such recognition has resulted in a system which discloses or suggests the present invention described and claimed hereinbelow.

The present invention provides a system which does meet the previously stated needs. The present invention is capable of processing a relatively large quantity of information which is received from the detection of a plurality of conditions associated with several operations. The system includes means which operates at a sufficiently rapid speed so that it is able to monitor the various conditions. Furthermore, the present invention is relatively compact.

The present invention also includes structural elements which can withstand the hazards encountered in environments as harsh as offshore drilling rigs in the North Sea and which comply with the governmental regulations applicable to such locations.

Broadly, the present invention provides an apparatus for monitoring a plurality of operations. The apparatus comprises a portable housing, a plurality of dedicated operation monitoring means associated with the housing so that each monitoring means is dedicated to monitor a respective one of the plurality of operations, and master microcomputer means associated with the housing for handling information transfers between each of the dedicated monitoring means.

The portable housing includes a skid having means for connecting the skid with a lift mechanism so that the portable housing can be moved. The skid further includes an enclosure mounted thereon for enclosing the master microcomputer means and portions of the monitoring means.

When the present invention is used on an offshore drilling rig, the plurality of dedicated monitoring means includes a microcomputer means dedicated to monitor the material blending operation, another microcomputer means dedicated to monitor the pumping operation and an additional microcomputer means dedicated to monitor the cementing operation. These three microcomputer means form a first level in a hierarchy of computer control.

Another level in the control hierarchy is established by the master microcomputer means which communicates with each of the microcomputer means on the first level of the hierarchy. This hierarchy of microcomputers provides the present invention with the advantages of being flexible and of being capable of monitoring a large number of conditions associated with each of the monitored operations.

To further enhance the flexibility and handling capability of the present invention, the apparatus includes input signal conditioning means for transforming electrical input signals into adjusted digital signals usable by a respective microcomputer means.

So that human control can be readily exercised over the microcomputer means, the apparatus further includes logic gate means which may be used for interfacing each microcomputer means with a respective microterminal means for entering information into and displaying information from the respective microcomputer.

From the foregoing it is a general object of the present invention to provide a novel and improved apparatus for monitoring a plurality of operations. Other and further objects, features and advantages of the present invention will be readily apparent to those skilled in the art when the following description of the preferred embodiment is read in conjunction with the accompanying drawings.

FIG. 3 is a functional block diagrams of the master communication control portion of the present invention.

FIG. 6 is a functional block diagram of the cementing monitor portion of the present invention.

FIGS. 7A–7D form a schematic circuit diagram of one of the central processing portions of the present invention.

Figure 8A:
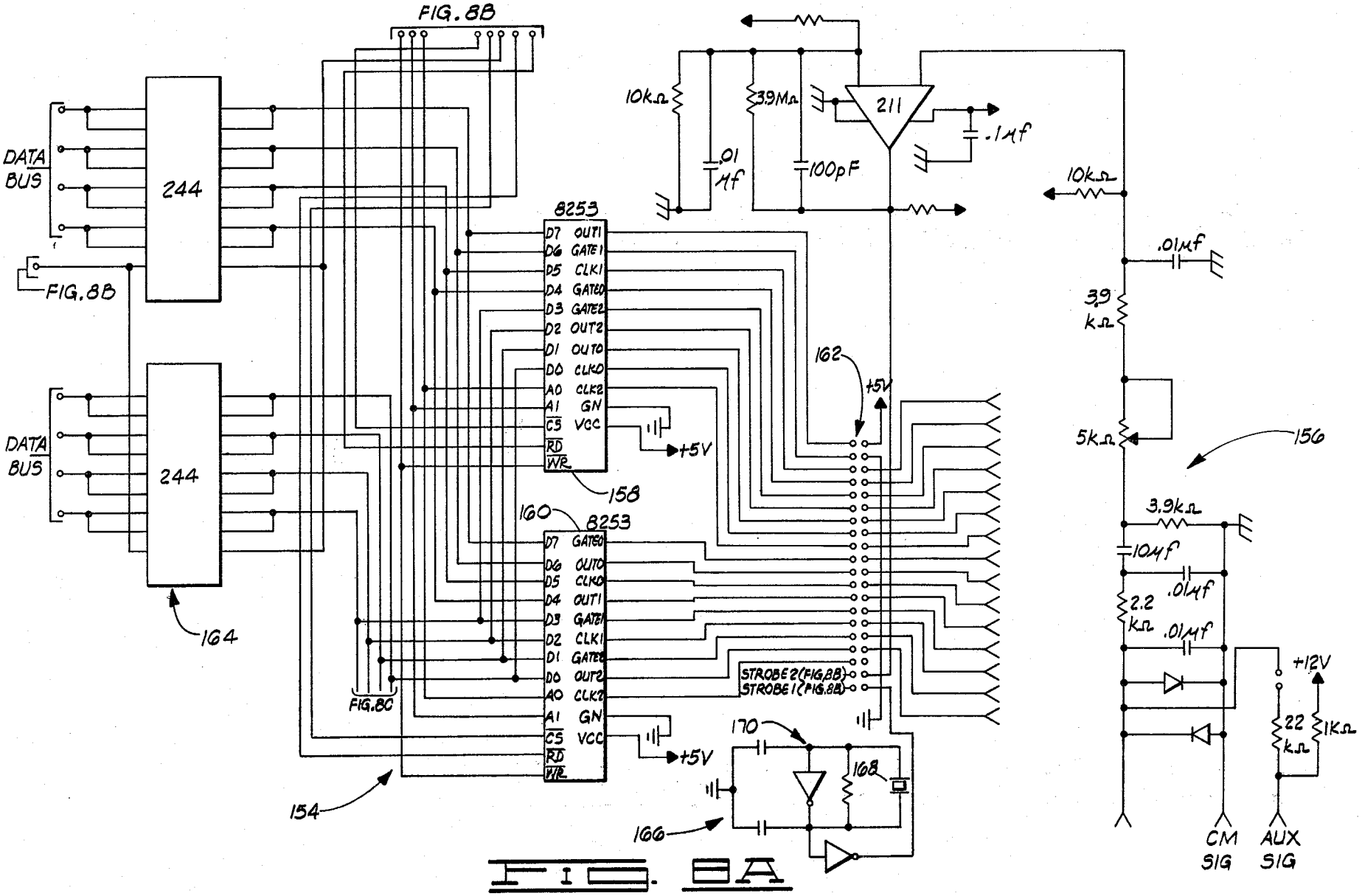
Figure 8B:
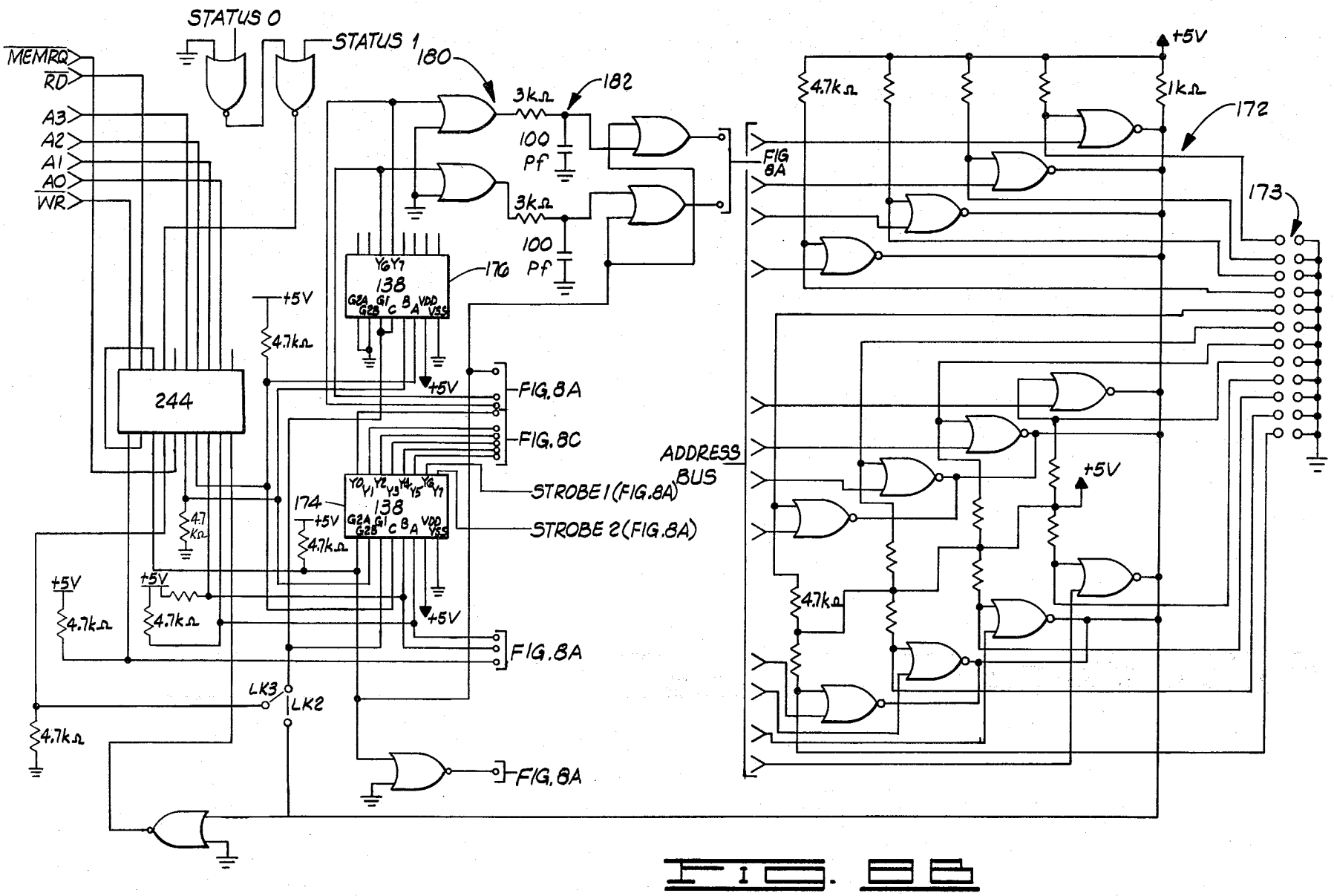
Figure 8C:
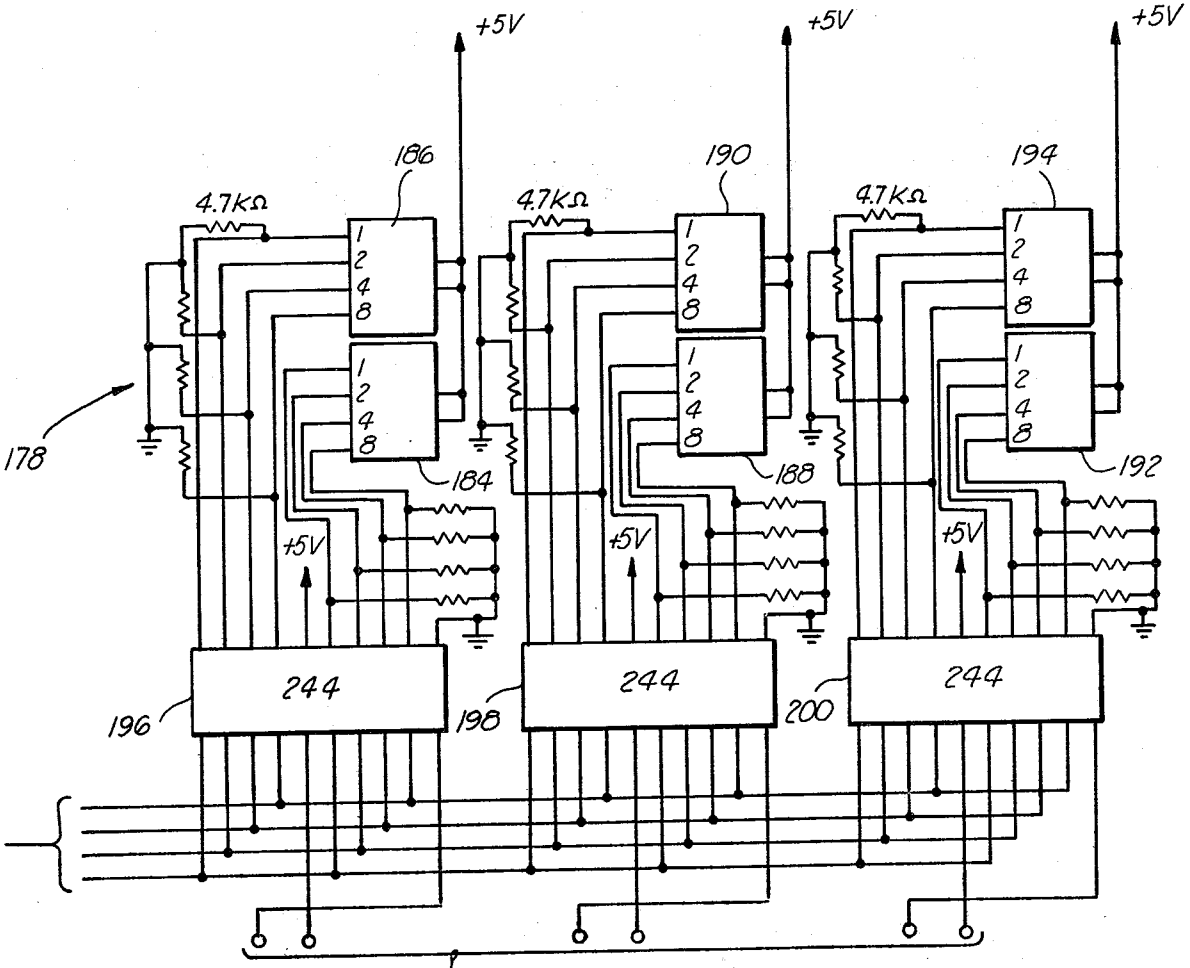
Figure 9:
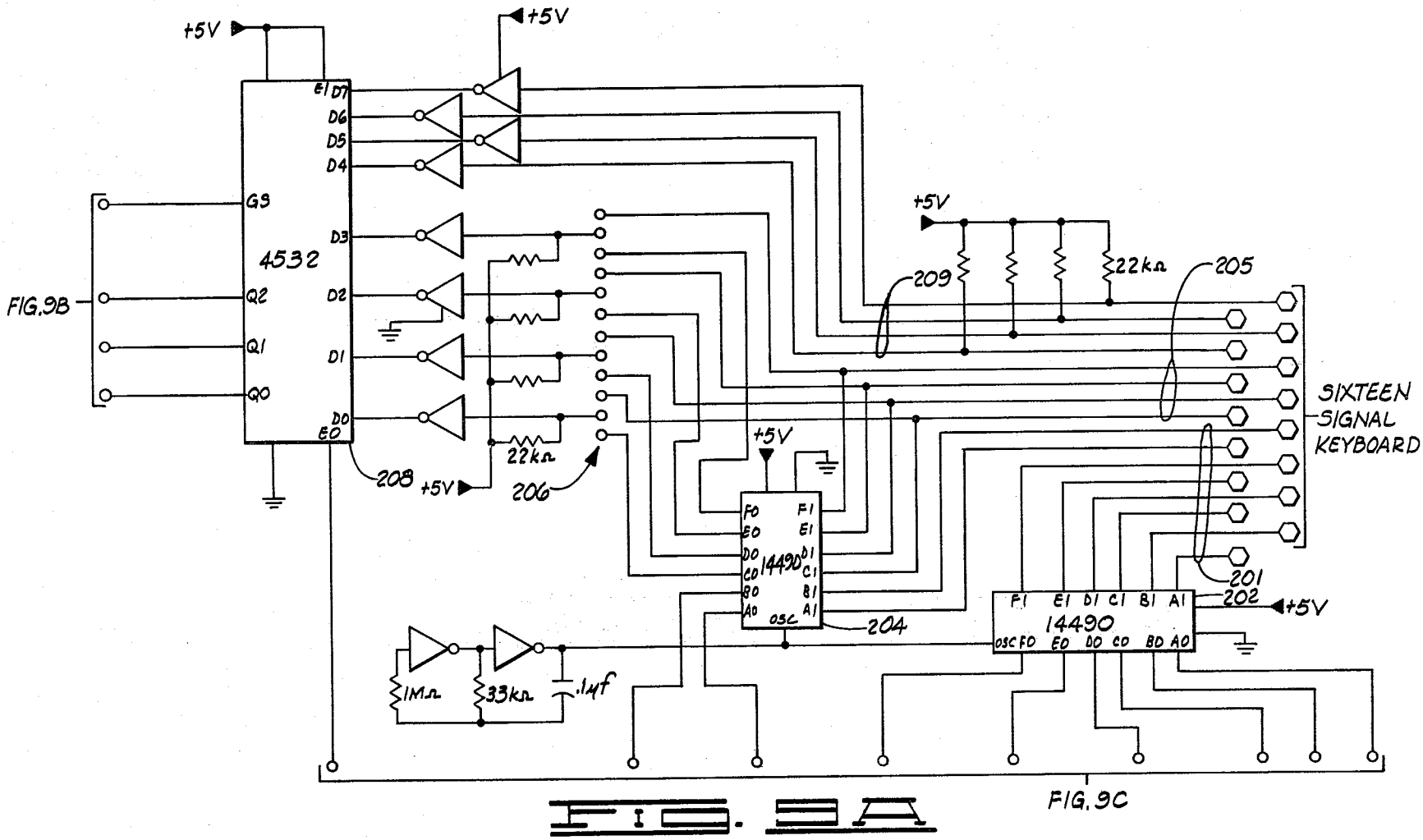
Figure 15:
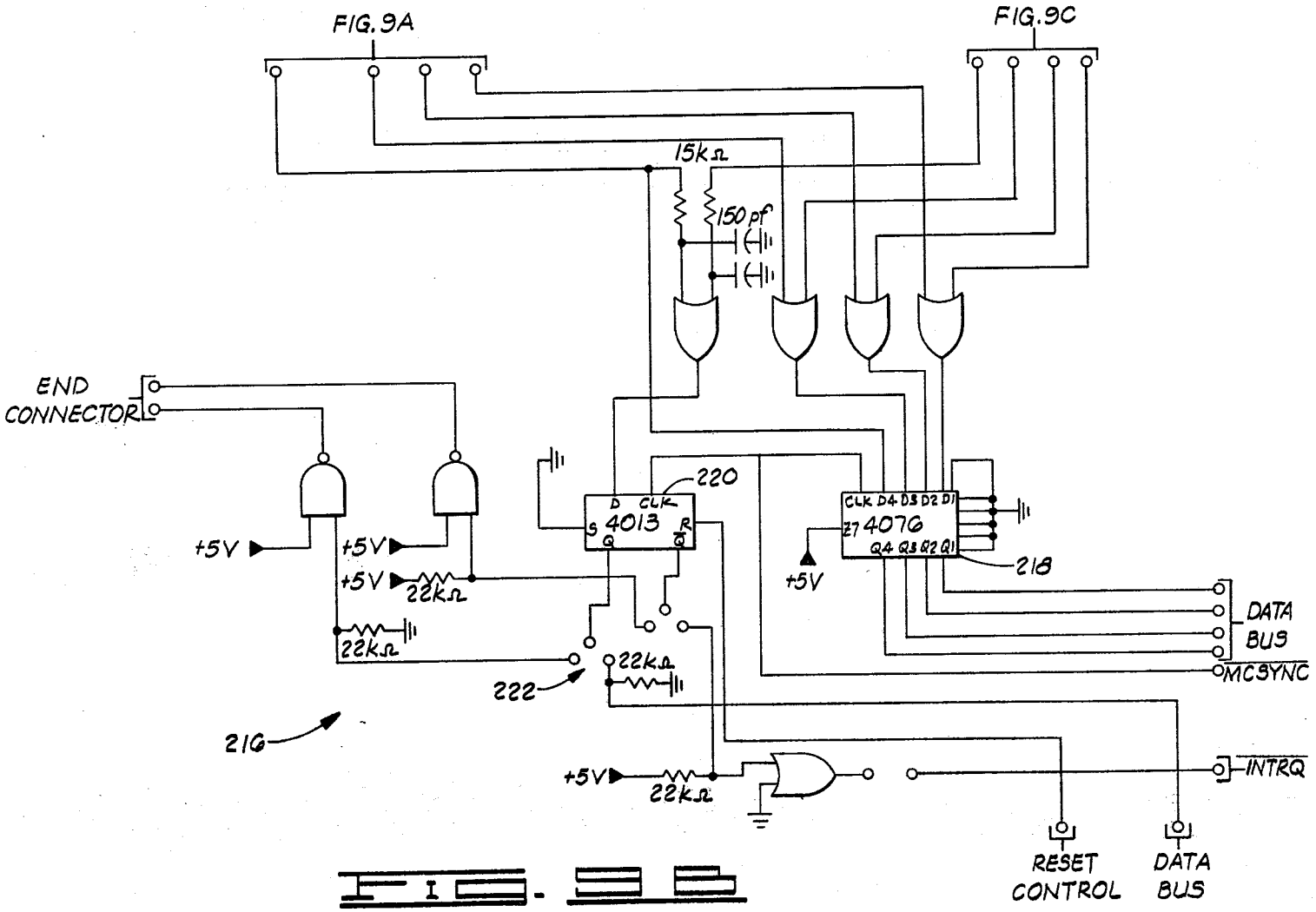
Figure 9E:
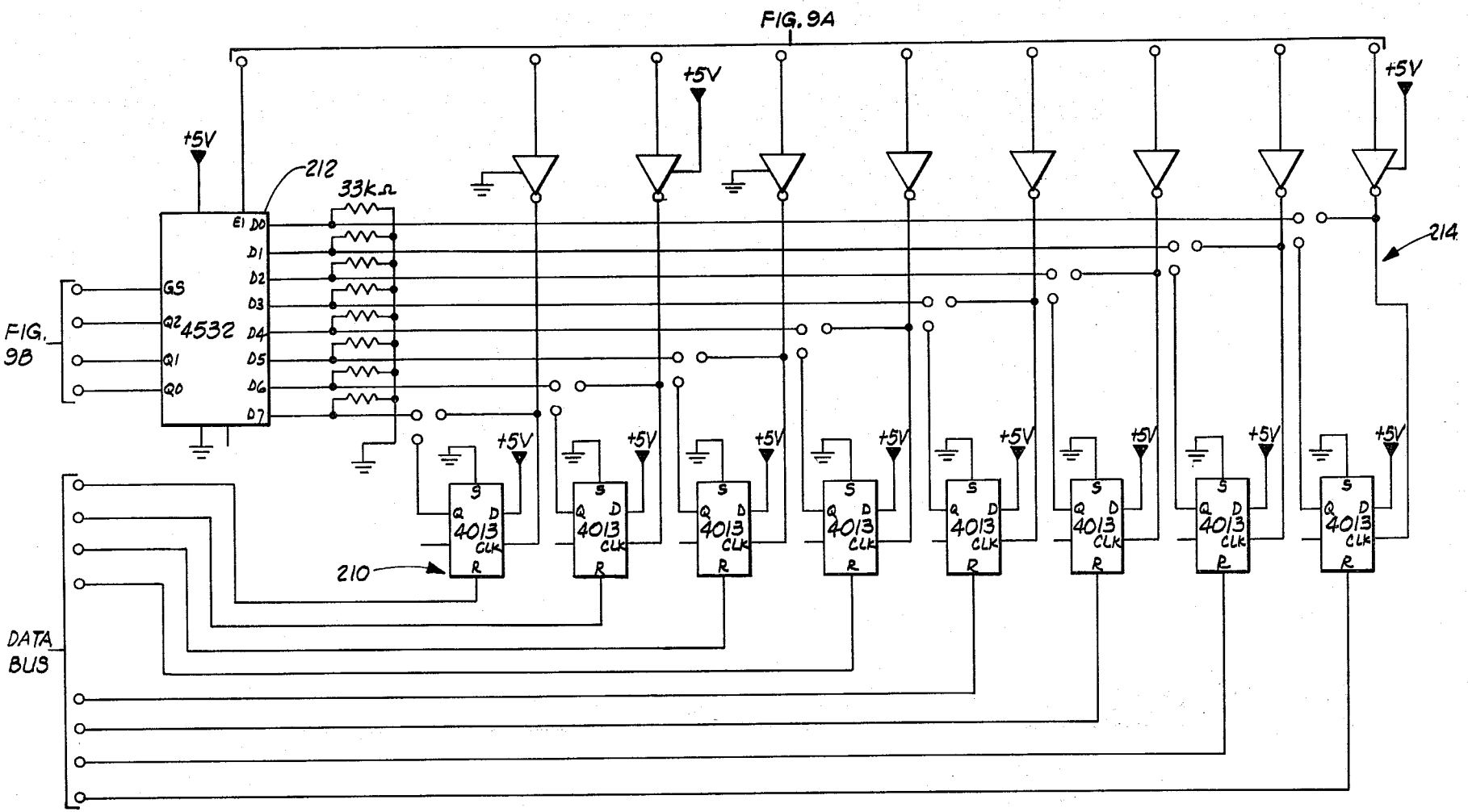

FIGS. 8A–8C form a schematic circuit diagram of one of the input signal conditioning portions of the present invention.

Figure 9:
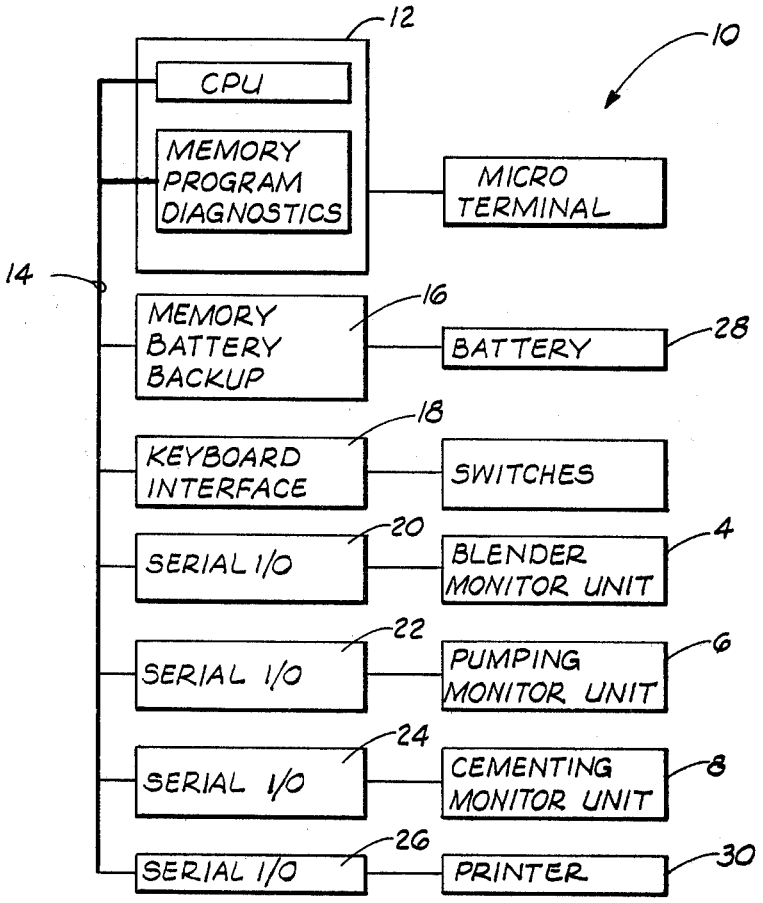

FIGS. 9A–9C form a schematic circuit diagram of one of the key input portions of the present invention.

Figure 10:
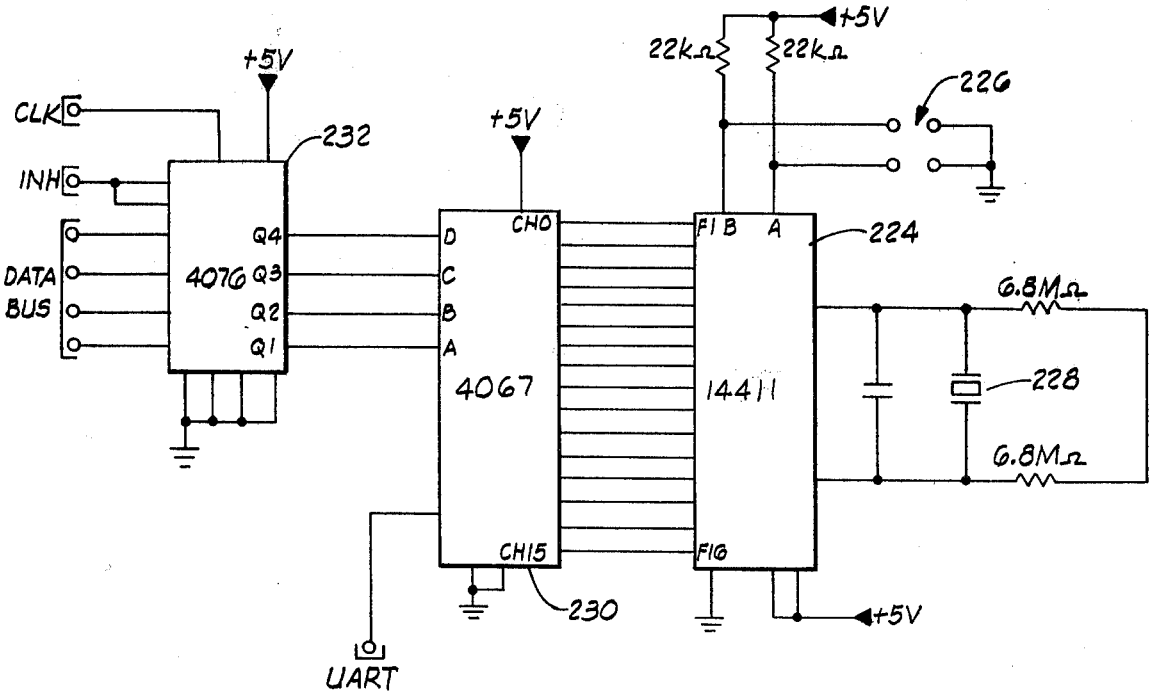

FIG. 10 is a schematic circuit diagram of one of the timer portions of a serial transmitter and receiver means of the present invention.

Figure 11:
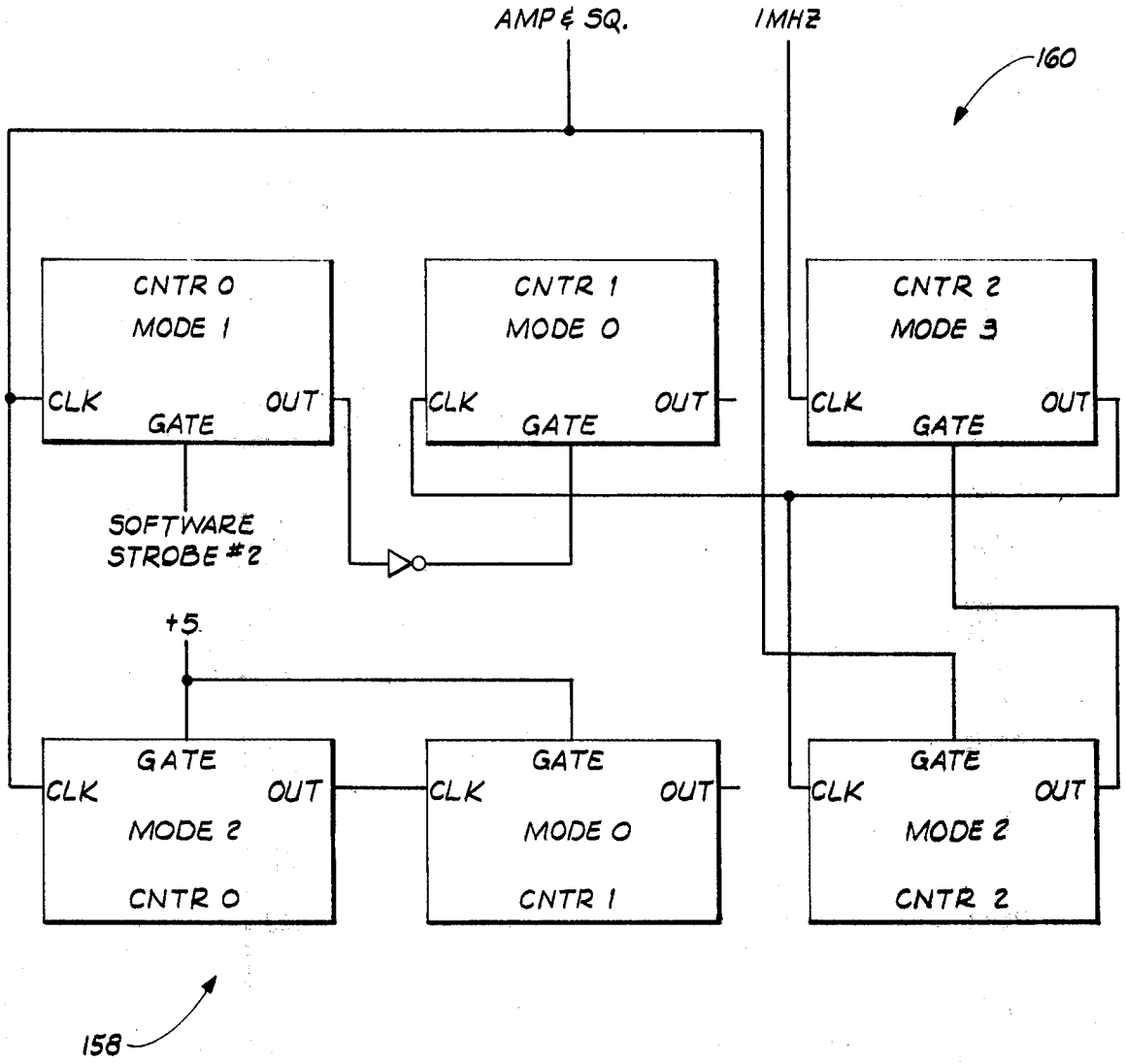

FIG. 11 is a block diagram of a preferred embodiment interconnection scheme for the counters of the input signal conditioning portions shown in FIG. 8A.

With reference to the drawings a preferred embodiment of an apparatus for monitoring a plurality of operations constructed in accordance with the present invention will be described. It is to be noted that although the apparatus is described hereinbelow with reference to monitoring conditions associated with various operations which are performed on an offshore drilling rig, it is contemplated that the present invention also be used to monitor conditions in other environments. The present invention is particularly useful on offshore drilling rigs because it provides a monitoring system which is compact and which complies with pertinent governmental regulations various countries enforce on offshore rigs located in their territorial waters.

Figure 1:
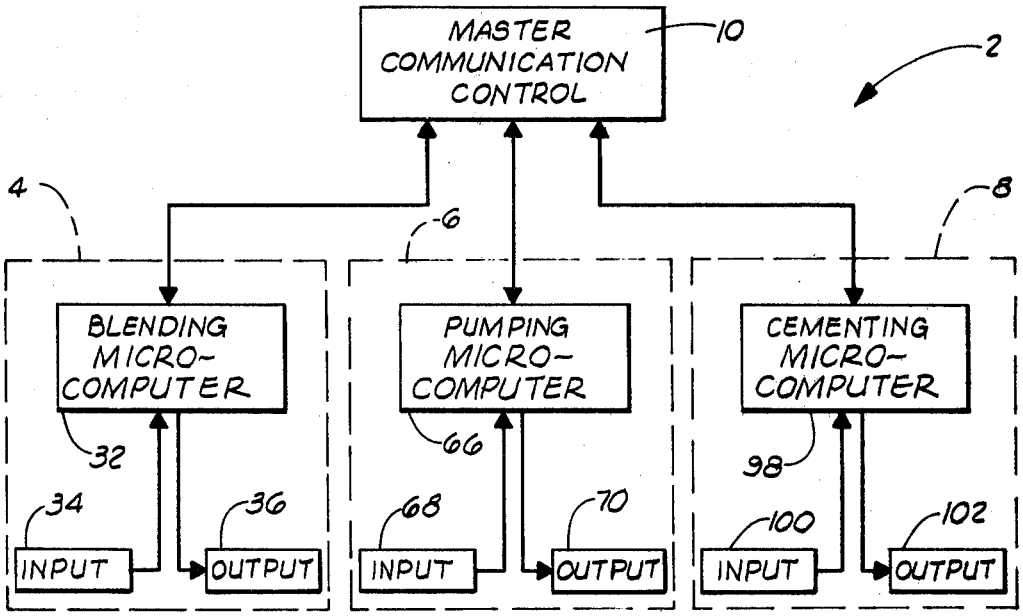
FIG. 1 is a functional block diagram of the information processing equipment of the present invention.

FIG. 1 discloses an information processing portion 2 of the present invention. The information processing portion 2 includes a blender monitor unit 4 for monitoring the blending of substances used for fracturing processes performed on the well at the offshore drilling rig, a pumping monitor unit 6 for monitoring the pumping of substances at the drilling rig, and a cementing monitor unit 8 for monitoring the cementing process at the rig. Each of the units 4–8 is dedicated to the monitoring of its respective operation and thus is on a common level with the other monitoring units so that a first level of a hierarchy of communication control is formed.

Another level in the hierarchy of communication control is provided by a master communication control unit 10 which forms another part of the information processing portion 2 of the present invention. The master communication control unit 10 handles information transfers between the lower level operation monitoring units 4–8. The master communication control unit 10 also formats information received from the monitoring units 4–8 and transmits the formatted information to a printer (not shown in FIG. 1) which is utilized in the present invention.

The heirarchy of control established by the first level of operation monitoring units 4–8 and the second level of the master communication control unit 10 gives the present invention the advantage of being flexible because additional operation monitoring units can be added without modifying the communication path along which the units of the common first level communicate. In other words, the vertical communication path between the lower first level and the upper second level of the hierarchy provides a more flexible system than would a horizontal communication path which extended directly between each operation monitoring unit. Furthermore, the vertical communication path of the present invention permits each of the operation monitoring units 4–8 to devote more time to monitoring conditions than to communicating with other units located on the same level of the hierarchy.

FIG. 3 discloses the master communication control unit 10 includes a central processing unit 12 which interfaces via a bus 14 with a memory battery backup unit 16, a keyboard interface unit 18, and a plurality of serial input/output units 20, 22, 24, and 26. The memory battery backup unit 16 has a reserve battery 28 associated therewith for providing a reserve power supply to maintain the associated memory in the event of a primary power supply failure. The keyboard interface unit 18 and the serial input/output units 20–26 will be more fully described subsequently with respect to FIGS. 9A–9C and 10. It is to be noted at present, however, that the vertical communication path between the two hierarchical levels is established via the serial input/output units 20–24 and the corresponding ones associated with the operation monitoring units 4–8. The serial input/output unit 26 is used to establish a communication path with a printer 30.

Figure 4:
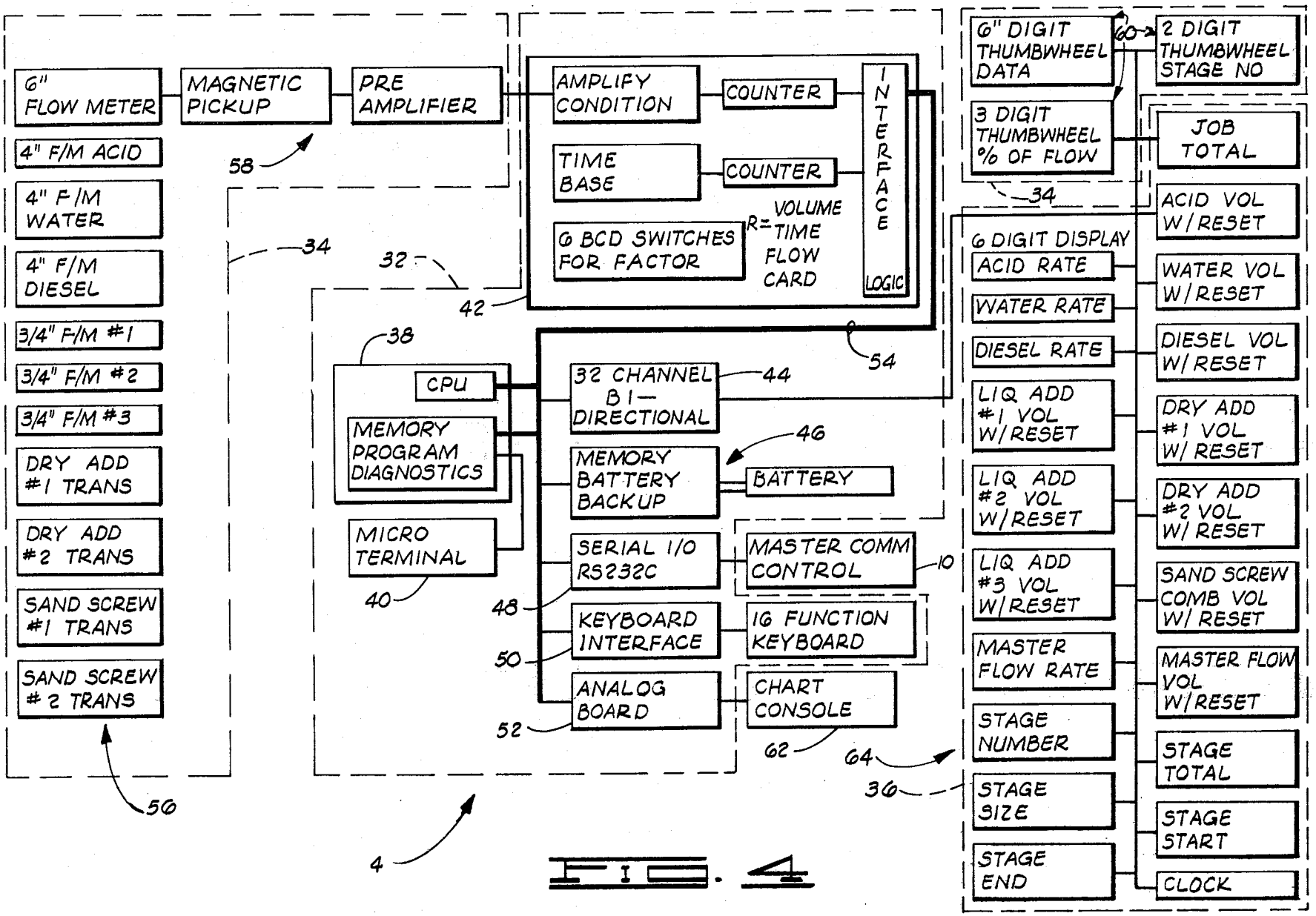
FIG. 4 is a functional block diagram of the blender monitor portion of the present invention.

The blender monitor unit 4 is shown in FIG. 1 to include a blending microcomputer means 32 for receiving input signals from input means 34 and providing output signals to output means 36. FIG. 4 shows the blending microcomputer means 32 includes a central processing unit 38, a microterminal 40, an input signal conditioning means 42, a 32-channel bidirectional unit 44, a memory battery backup unit 46, a serial input/output unit 48, a keyboard interface unit 50 and an analog unit 52. A communication path among these elements is provided by an appropriate bus 54.

The input signal conditioning unit 42 receives an input signal from an input sensor which detects the value of a predetermined condition associated with the blender operation. As shown in FIG. 4 there are a plurality of input sensors 56 used to detect various conditions. The sensors 56 comprise a portion of the input means 34 and include in the preferred embodiment flow meters for detecting the flow of fluids and also include various transducers as are known in the art for determining the flow of dry materials. Each of the input sensors 56 detects the physical condition, such as the transfer of blending material, and converts it into a corresponding electrical signal, such as by a magnetic pick-up and preamplifier unit 58 illustrated in FIG. 4. Although only a single input signal conditioning unit 42 is shown in FIG. 4, there is one input signal conditioning unit 42 connected to the bus 54 for each of the sensors 56. Therefore, because there are eleven sensors depicted in FIG. 4, there are eleven input signal conditioning units 42 in the illustrated preferred embodiment of the blending microcomputer unit 32.

The input means 34 of the blender monitor unit 4 also includes a plurality of thumbwheel switches 60 which permit manual entry of data into the monitoring unit 4. This data is entered over the bus 54 through the 32-channel bidirectional unit 44.

The 32-channel bidirectional unit 44 provides circuitry as subsequently described by which the central processing unit 38 can select any one of thirty-two input or output devices.

The memory backup unit 46 and the keyboard interface unit 50 are similar to those mentioned with respect to the master communication control unit 10 shown in FIG. 3.

The serial input/output unit 48 complements the respective serial input/output unit 20 of the master communication control unit 10 to provide the vertical communication path between the blender monitor unit 4 and the master communication control unit 10.

The analog unit 52 provides electronic circuitry as known in the art for interfacing the central processing unit 38 with a strip chart recorder 62.

The output means 36 of the blender monitor unit 4 includes a plurality of display devices 64 for visually indicating various parameters which are calculated by the central processing unit 38 from the conditions detected by the input sensors 56. Specific parameters which are displayed by the preferred embodiment are indicated in the labeled boxes shown in FIG. 4. Generally, the output means 36, as well as subsequently described output means, provides means for displaying output signals in a humanly understandable form.

The pumping monitor unit 6 is shown in FIG. 1 to include pumping microcomputer means 66, input means 68, and output means 70. Each of these means of the pumping monitor unit 6 are more particularly disclosed in FIG. 5.

The pumping microcomputer means 66 includes a central processing unit 72 which is constructed similarly to the central processing unit 38 in the blender monitor unit 4. The pumping central processing unit 72 is connected via an appropriate bus 74 to input signal conditioning means 76, a 32-channel bidirectional means 78, memory battery backup means 80, serial input/output means 82 and keyboard interface means 84. Each of these is constructed similarly to the respective unit mentioned in the preceding description of the blender monitor unit 4. The pumping microcomputer unit 66 communicates with the master communication controller unit 10 via the respective serial input/output means 82 and 22.

The input means 68 of the pumping monitor unit 6 includes appropriate transducers to sense the volumetric flows and the pressures of a plurality of pumps which are used on the drilling rig. Each of the volumetric flow transducers detects the flow through the pump and converts it into a corresponding electrical signal which is provided to a respective input signal conditioning means 76 associated with the particular transducer. Each pressure transducer converts the detected pressure into a corresponding electrical signal which is transmitted to an analog board 86 having an electronic circuit for receiving a multitude of electrical signals and electrically switching them to both the system bus 74 and to the strip chart console 62 associated with the present invention. In addition to monitoring the various pumps, the pumping monitor unit 6 of the preferred embodiment also monitors the manifold pressure, the auxiliary pressure, the natural gas liquid suction manifold pressure, and the natural gas liquid suction temperature as represented by the labeled boxes in FIG. 5.

Figure 5:
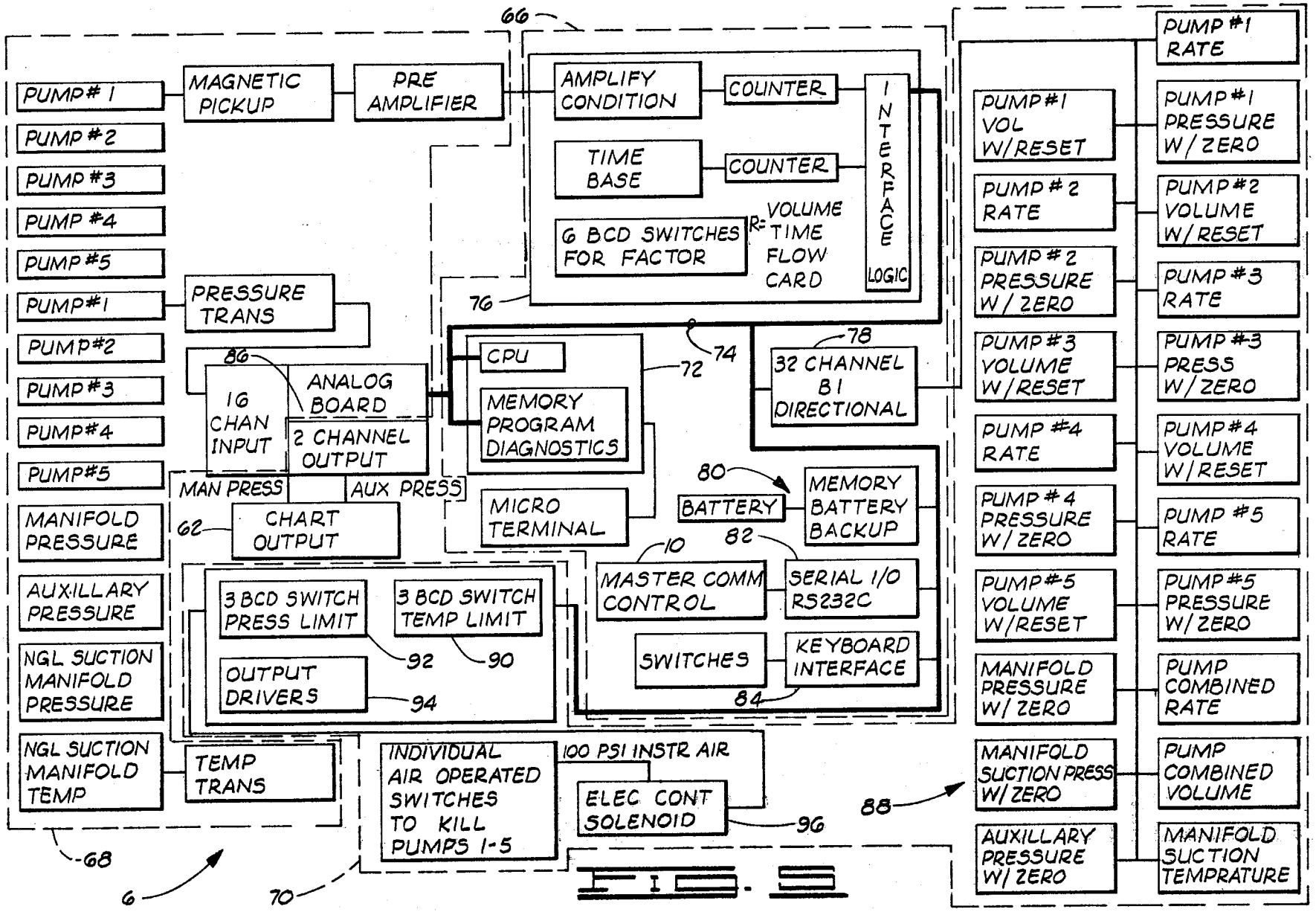
FIG. 5 is a functional block diagram of the pumping monitor portion of the present invention.

As each of the input signals is detected and processed by the pumping microcomputer means 66, the various computed values are displayed by the output means 70 of the pumping monitor unit 6. FIG. 5 indicates that the output means 70 includes appropriate visual display means 88 for displaying the volume, rate and pressure of each of the pumps. Also displayed are the combined rate and volume of the pumps and the manifold pressure, manifold suction pressure, auxiliary pressure, and manifold suction temperature.

So that the pumps may be deactivated when predetermined limits are passed, the pumping monitor unit 6 includes means for setting a predetermined value and means for controlling the actuation of the pumps. In particular, FIG. 5 discloses that the value setting means includes appropriate binary coded decimal switches 90 and 92 by which temperature limits the pressure limits can be set and read by the central processing unit 72 over the system bus 74. When these limits are exceeded by the actual detected values, the central processing unit 72 sends appropriate control signals to output drivers 94 to actuate an electrically controlled solenoid 96 connected to the on/off controls of the pumps. The output drivers 94 and solenoid 96 comprise the pump actuation control means.

FIG. 1 also shows that the cementing monitor unit 8 includes a cementing microcomputer means 98, input means 100, and output means 102. These elements are more particularly disclosed in FIG. 6.

An examination of FIG. 6 discloses elements which are similar to those shown in FIGS. 4 and 5. In particular the cementing microcomputer means 98 includes elements similar to those previously described, as shown in FIG. 6, and communicates with the master communication control unit 10 via a respective serial input/output device 104.

The input means 100 includes appropriate transducers as illustrated in FIG. 6 for detecting the volumetric flow and pressure of respective pumps. Additionally, the input means 100 includes a number of thumbwheel switches 106 by which data pertaining to various liquid additives can be entered into the cementing monitor unit.

The output means 102 includes various visual display means 108 for indicating the various parameters identified in FIG. 6. The cementing monitor unit 8 also includes pump control means 110 for deactivating the pumps when a predetermined pressure limit is exceeded. The pump control means 110 is similar to the corresponding member of the pumping monitor unit 6 shown in FIG. 5.

Figure 2:
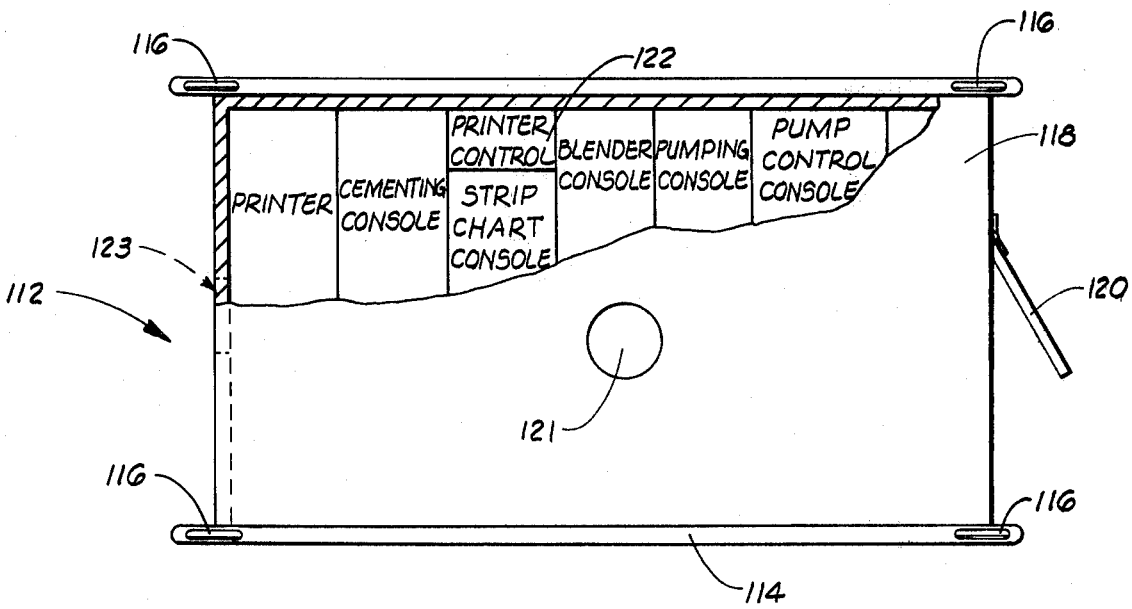
FIG. 2 is a schematic illustration of a housing, shown in partial section, and the location therein of respective equipment consoles of the present invention.

As schematically illustrated in FIG. 2, the majority of the previously described electronic components which comprise the present invention are contained within a housing 112. The housing 112 is constructed to permit easy deployment of the present invention and to provide a safe environment for the components. The components which are not contained within the housing 112 include the various transducers which are located physically near the apparatus and conditions they are monitoring. Additionally, in the preferred embodiment there are various readout devices located near the blender, pumping, and cementing equipment. For example, a counter and analog rate meter for a master fluid, a counter and analog rate meter for each of three major fluids (water, diesel, and acid), a counter and analog rate meter for each of three liquid additives, a counter and analog rate meter for each of two dry additives, and a counter and rate meter for registering the combined total and rate for sand screws are provided on a preferred embodiment of the blender. The blender readout also contains means for providing necessary calibration signals for presetting individual channels for match meter operations. As another example, a Martin Decker pressure recorder is used in a preferred embodiment of the pumping unit to monitor the manifold pressure of the unit. The cementing skid, for example, will have readouts pertaining to dual volume and rate, density, combined volume and rate and the water volume and rate.

The housing 112 includes a skid 114 which is preferably constructed of steel and which has means for connecting with an apparatus which can lift or otherwise move the housing 112. Specifically, the connecting means shown in FIG. 2 includes four lifting eyes 116, each located at a respective corner of the skid 114. Other suitable means can be used.

Mounted on the skid 114 is an enclosure 118 which is preferably constructed of steel. The enclosure 118 includes a door 120 by which access into the interior of the enclosure is obtained. In a preferred embodiment the door 120 permits entry into an air-lock portion (not shown) of the enclosure 118. The internal material of the enclosure must be non-flammable or at least flame retardant for the safety of the personnel and equipment therein. Preferably, the enclosure 118 includes appropriate fire walls and fireproof shutters. Rig-standard lighting can also be used in the enclosure 118.

The connections between the transducers monitoring the respective conditions and the electronic equipment located in the enclosure 118 are preferably made via instrumentation cables extending through water-tight multi-cable transits disposed in the side and top of the enclosure 118. There are adequate electrical outlets and overhead lighting fixtures in the enclosure 118, and standard electrical service is from a suitable source, such as a 110-$V_{AC}$, 60-Hz source which can be obtained by using an appropriate type of transformer to reduce a 220-$V_{AC}$, single phase source to a 110-$V_{AC}$ level which can be isolated and regulated by suitable means known in the art. All internal wiring is preferably installed in flexible conduit. Electrical service is protected through a breaker box preferably located near the door 120. All switches for overhead lighting are preferably waterproof, and adequate grounding of the equipment is maintained throughout the housing. When the skid 114 is used on an offshore drilling rig, it is preferably a maximum of 8 feet wide and 15 feet long.

FIG. 2 discloses that there are various consoles disposed within the enclosure 118. These consoles include the displays and controls which are associated with the master communication control unit 10, the blending monitor unit 4, the pumping monitor unit 5 and the cementing monitor unit 8. Additionally, the strip chart console 62, the printer console 30 and a printer control panel 122 are contained therein.

To prevent the electrical circuits comprising the various consoles from causing an explosion or fire by igniting explosive or inflammable gases which exist at an oil drilling rig, the enclosure 118 includes an air entry port 121 and an air damper/exit port 123 through which high volume purge air from the rig's air system can pass to clear the gases and to maintain positive pressure and thereby purge the ignitable or detonable gases from the enclosure 118. The air entry port 121 is shown in FIG. 2 disposed in the top wall of the enclosure 118, and the exit port 123 is shown positioned in the back wall of the enclosure 118.

The preferred embodiment of the present invention shown in FIGS. 2–6 is contemplated to be used with a specific composition of pumping, blending and cementing equipment used on offshore platforms. This specific composition includes five HT-400 electrically driven pump skids, one fifty-barrel electrically driven blender, one twin V-16 diesel cementing unit, one recirculating cement mixer skid, one LP mixing skid, and accompanying manifolding. This equipment is provided by Halliburton Services and is to be monitored so that essential parameters derived from the monitoring process are recorded by visual readout, strip chart recorder and printer. Although the monitoring apparatus constructed in accordance with the present invention is contemplated to be used with this specific composition of equipment located on an offshore drilling platform, the apparatus may be used with other types of equipment in other environments.

With reference to FIGS. 7–10 a preferred embodiment of particular elements common to each of the monitoring unit microcomputer means 32, 66 and 98 will be described. It is to be noted that in the preferred embodiment contemplated by the present invention each microcomputer means comprises a plurality of rack mountable printed circuit boards thereby providing a modular system which is versatile because various combinations of boards can be used to create different system configurations. The modular system also is easy to maintain because defective boards can be readily interchanged with non-defective ones. The circuit boards or cards used in the embodiment of the present invention mounted in racks located in the enclosure 118 on an offshore drilling rig are preferably approximately 4½ inches by 6½ inches.

FIGS. 7A–7D disclose the preferred embodiment circuit which is contained on each of the central processing unit circuit boards 12, 38, 72 and 124 respectively associated with the master communication control unit 10, blending microcomputer unit 32, pumping microcomputer unit 66 and cementing microcomputer unit 98 as shown in FIGS. 3, 4, 5 and 6, respectively.

FIG. 7A shows each central processing unit circuit board or card includes an integrated circuit microprocessor 130. In the preferred embodiment the microprocessor 130 is an RCA 1802 CMOS chip; however, any other suitable microprocessor may be used. Each central processing unit is programmed so that the microprocessor 130 can handle 8-bit words. The microprocessor 130 includes its own timing circuit having a crystal 132 capable of providing a 2.5 MHz timing signal for the preferred embodiment. So that the microprocessor 130 can communicate over a "standard" bus (which type of bus is known in the art), the central processing unit board includes logic gate means 134 for providing a suitable interface between the microprocessor 130 and the standard bus. The various standard bus signals are identified by the appropriate mnemonics listed in FIG. 7A. For example, two of the standard bus signals are the bus request (BUSRQ) and the bus acknowledge (BUSAK) signals which permit other units connected to the standard bus to take control thereof from the microprocessor 130.

Figure 7C:
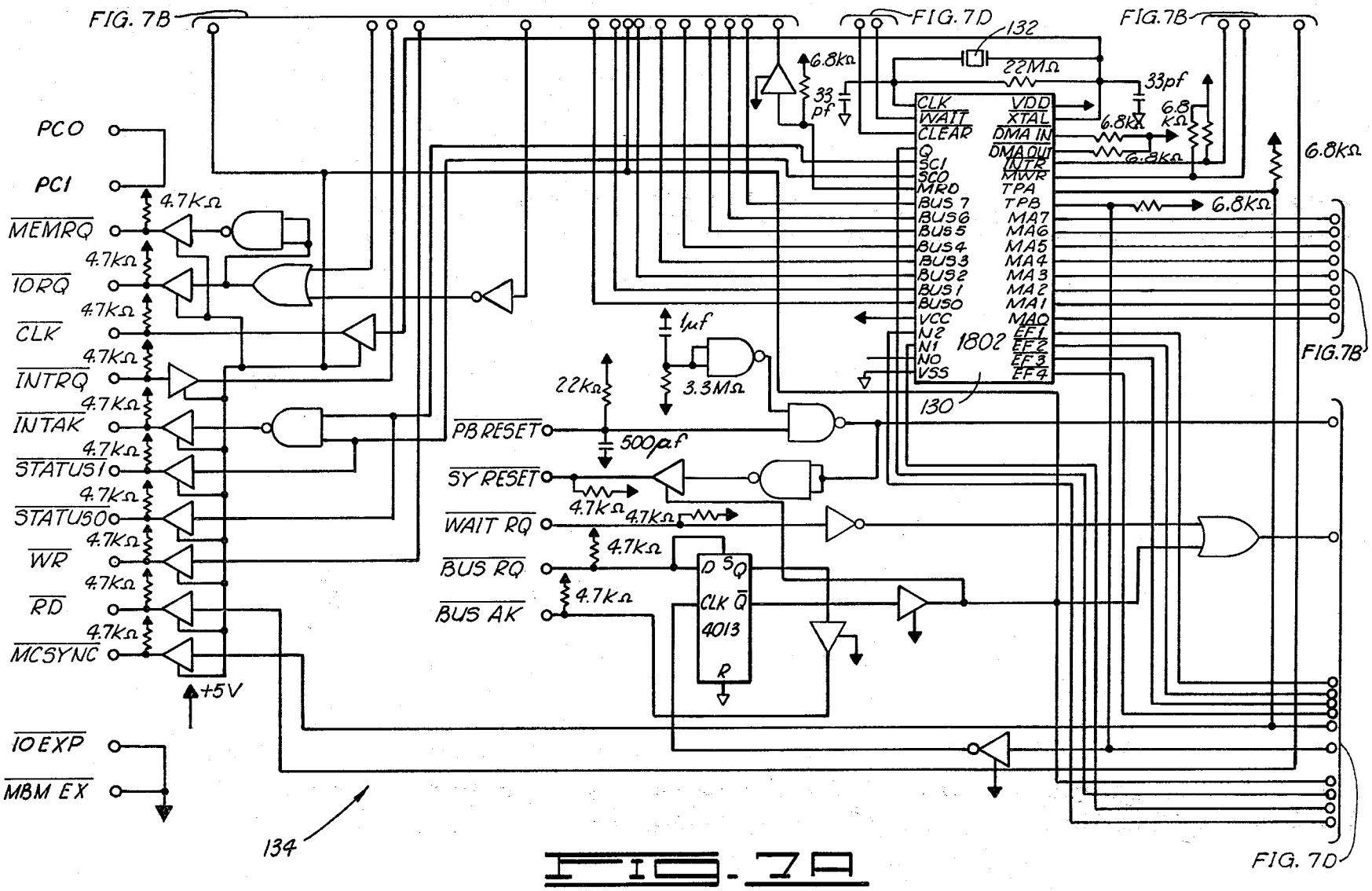
Figure 7B:
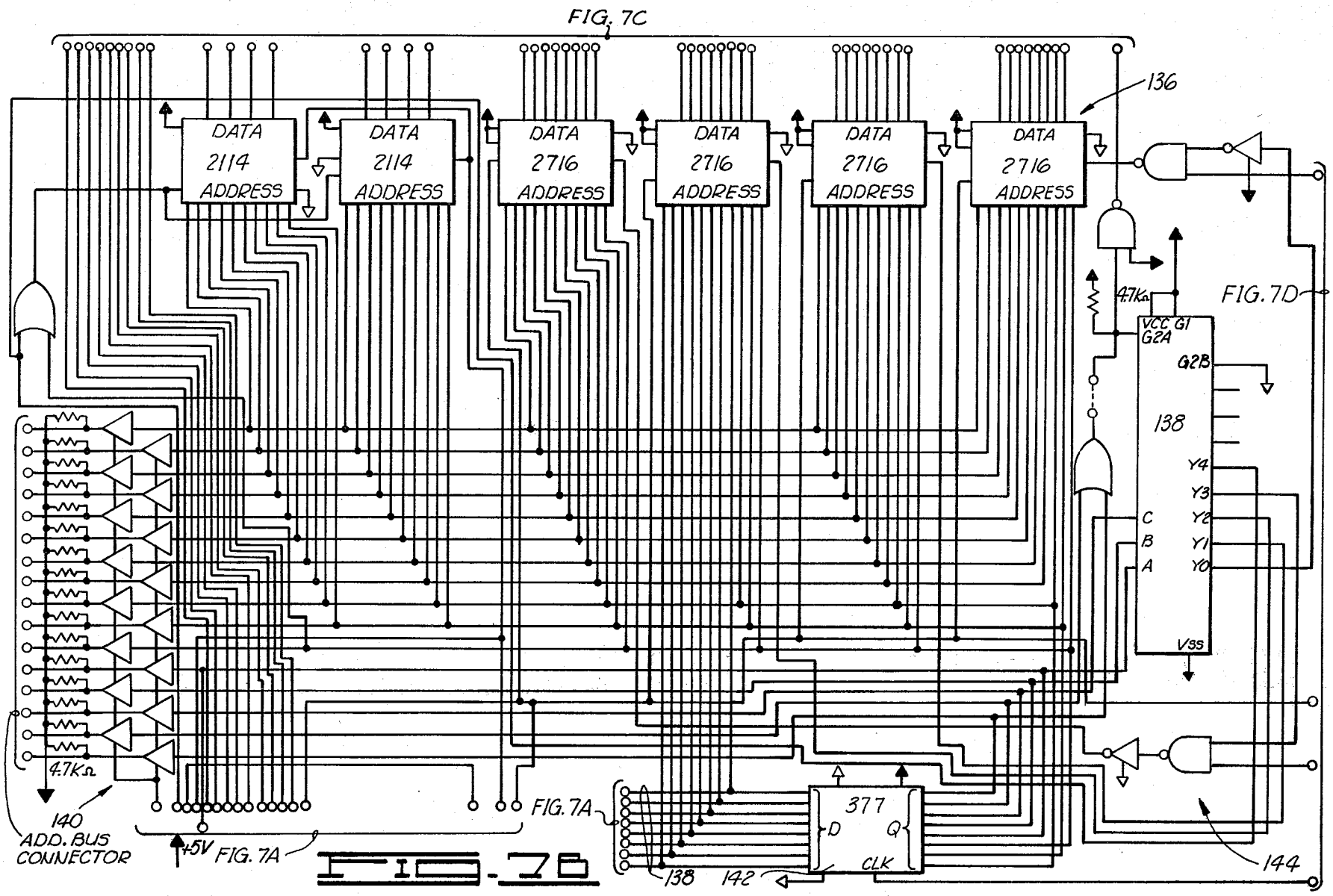
Figure 7C:
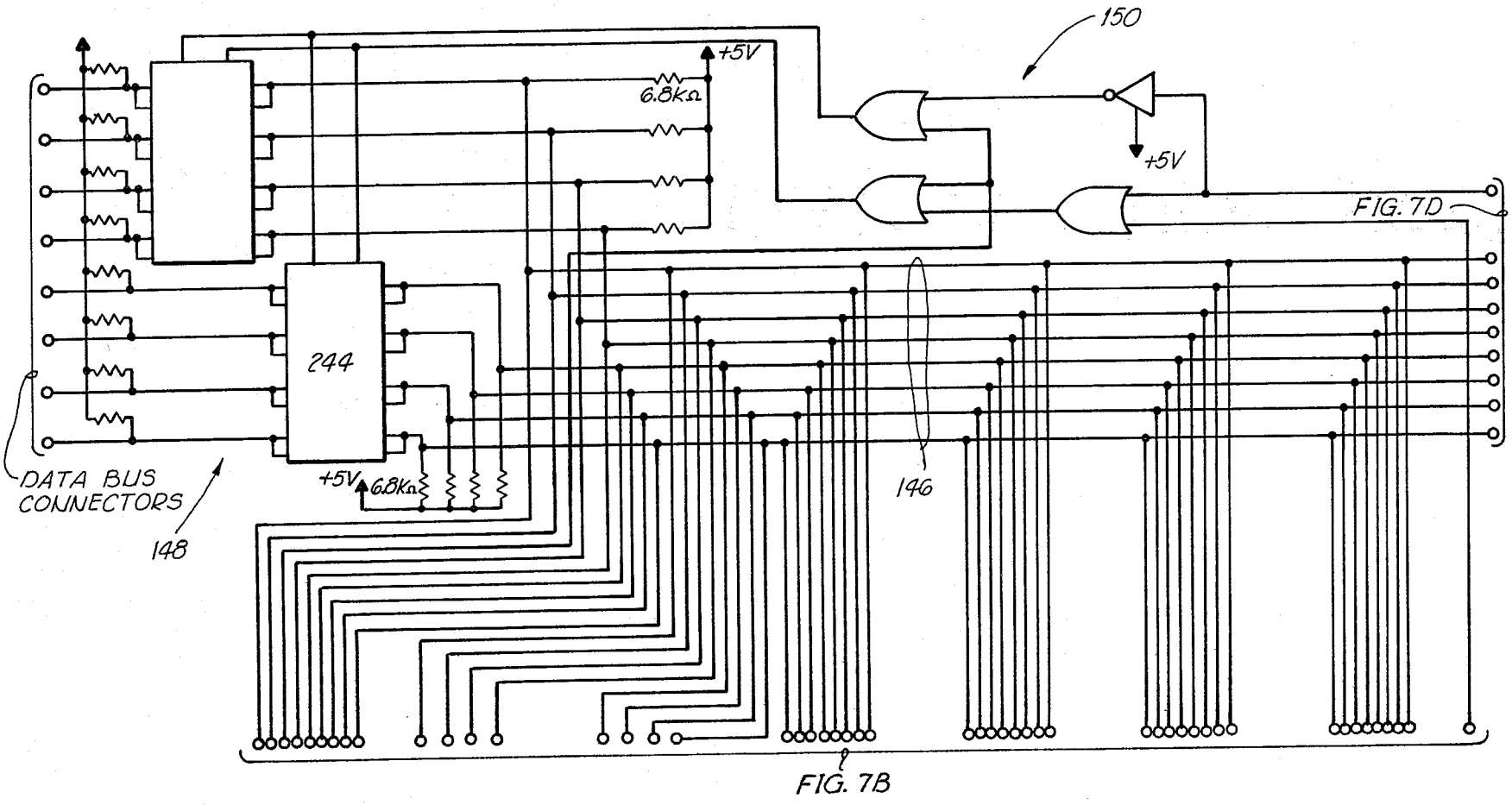

FIG. 7B shows solid state integrated circuit memory 136 located on the central processing unit board and an address bus 138 extending from the microprocessor 130 to the memory 136 and to address bus integrated circuit buffers 140. The preferred embodiment memory 136 includes 1*k* of random access memory (RAM) and 8k of erasable programmable read-only memory (EPROM).

FIG. 7B further discloses integrated circuit latch means 142 having input connected to the address bus 138 and having respective ones of its outputs connected to the address bus 138 and others of its outputs connected to both the address bus 138 and to logic gate means 144 by which memory located externally of the central processing unit board can be addressed (e.g., random access memory located on the memory battery back-up board). This feature of the present invention provides versatility thereto because expanded quantities of memory can be utilized to increase the information processing capacity of the respective microprocessor 130.

FIG. 7C discloses a data bus 146 extending from the microprocessor 130 and memory 136 to the other elements connected to the data bus. The data bus 146 is bidirectional and is buffered by tri-state data bus buffers 148 as are known in the art. To control the state of the buffers, the present invention includes logic gate means 150 responsive to respective ones of the signals disclosed in FIGS. 7A, 7B, and 7D. It is to be noted that the data bus 146 and the address bus 138 for each respective central processing unit form a part of the respective system bus of the units shown in FIGS. 3–6.

Figure 7D:
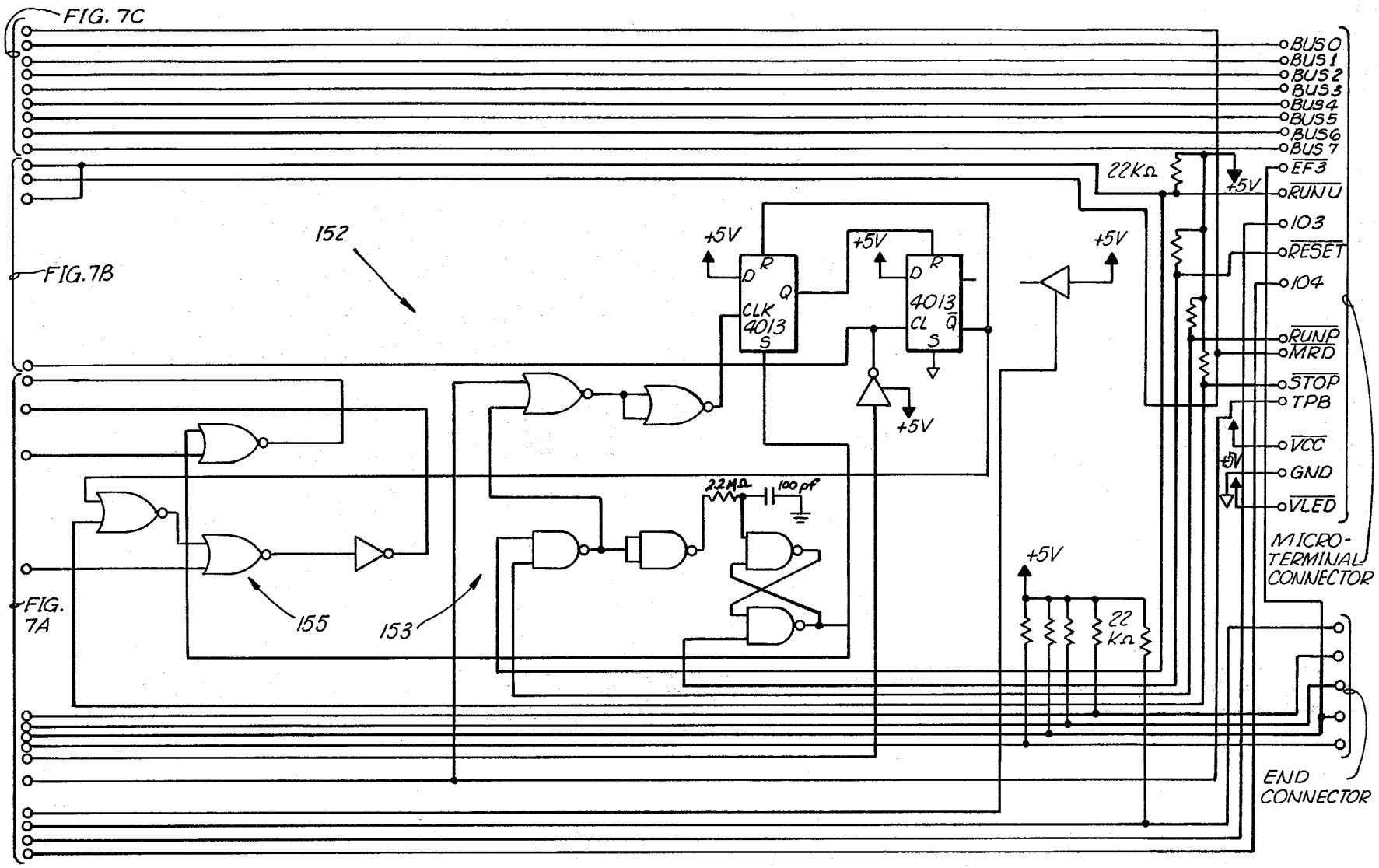

FIG. 7D discloses circuit means for interfacing the microcomputer unit board with a microterminal (not shown). The microterminal may be handheld unit as is known in the art (e.g., a microterminal of the type manufactured by RCA). The interfacing means permits the microterminal to read from or write to any memory location which is accessible by the microprocessor 130. Furthermore, the microterminal can control the microprocessor 130 to single step through a program or to start the program at any step. This feature is desirable for running diagnostic programs. FIG. 7D particularly discloses logic gate means 152 connected in the illustrated configuration for providing the interface between the central processing unit board and the microterminal.

The logic gate means 152 includes first combinational logic gate means 153 for providing a latched output which is applied to an input of a second combinational logic gate means 155. The first combinational logic gate means 153 includes inputs which are electrically connectable to respective ones of the TPB, $\overline{\text{RUNU}}$ and $\overline{\text{RUNP}}$ control terminals of the preferred embodiment RCA microterminal. The second combinational logic gate means 155 includes inputs which receive signals from the $\overline{\text{PBRESET}}$, $\overline{\text{WAITRQ}}$ AND $\overline{\text{BUSRQ}}$ standard bus lines in addition to the input which receives the output from the first combinational logic gate means 153. The means 155 also includes both a first output which is connected to the $\overline{\text{CLEAR}}$ input of the preferred embodiment 1802 microprocessor and a second output which is connected to the $\overline{\text{WAIT}}$ input of the 1802 microprocessor.

FIGS. 8A–8C disclose one of the circuit boards or cards containing the electronic circuitry of the input signal conditioning means shown in FIGS. 4–6 to be included in each of the monitoring units 4–8. There is one such card for each input transducer included within the system. The input signal conditioning means includes a pulse rate counter 154 which can be adjusted either by manually made connections or by software instructions. The pulse rate counter 154 counts pulses which are provided by an amplification and squaring circuit 156 shown in FIG. 8A. The amp-and-square circuit 156 receives a signal from the associated transducer of the input means and amplifies and squares it as is known in the art to provide an electrical signal comprising a series of pulses corresponding to the magnitude of the condition detected by the transducer. Particularly, the amp and square circuit converts a low level voltage signal into a signal having a voltage level identifiable by logic circuit means (i.e., a digitally recognizable signal).

The electrical signal from the circuit 156 is connected via an electrical strap to the pulse rate counter means 154. In the preferred embodiment the counter means 154 includes two Intel 8253 integrated circuit counters 158 and 160. Each of the 8253 chips includes three digital counters which are manually selectably connected in a predetermined counting configuration by suitable electrical straps connected in a counter select header 162 having a plurality of pins which can be electrically shorted together. A specific embodiment of the counters contained in the two 8253 chips and interconnected in accordance with the present invention is illustrated in FIG. 11.

The selected configuration of counters is programmed by means of appropriate data entries made over the data bus 146 to which the counters 158 and 160 are connected via data bus buffer means 164. Data can be written into the counters 158 and 160 to preset the count, and data can be read from the counters 158 and 160 to indicate the number of pulses (or the adjusted number of pulses if the counters were pre-programmed) detected in the electrical signal provided by the amplification and squaring circuit 156.

The counters 158 and 160 can be clocked by timing means 166 which operates independently of the timing means of the microprocessor 130. FIG. 8A discloses the preferred embodiment timing means 166 includes a crystal 168 and associated components 170 for providing a 1 MHz time base.

FIG. 8B discloses logic gate means 172 connected to decode a sixteen-bit address set by an address header 173 and used to identify the particular input signal conditioning board which is desired to be communicated with by the microprocessor 130. Other types of address decoding configurations can be used.

FIG. 8B further shows that the input signal conditioning board includes a three-line-to-eight-line multiplexer 174 and a second three-line-to-eight-line multiplexer 176. The first multiplexer 174 is appropriately addressed to select one of a plurality of data input switches 178 subsequently described with reference to FIG. 8C. The second multiplexer 176 is appropriately addressed to control logic gate means 180 and resistor/capacitor circuit means 182 connected thereto for modifying the timing of the microprocessor 130 so that it is compatible with the 8253 counters 158 and 160. In particular, the timing is modified by delaying the Memory Read signal from the 1802 microprocessor 130 so that it will not be detected by the counters 158 and 160 until after a valid address is provided to the counters 158 and 160. Appropriate control signals are provided to the multiplexers 174 176 through either a link 2(LK2) strap or a link 3(LK3) strap as shown in FIG. 8B. In the preferred embodiment of the present invention as disclosed herein, the control signals are provided through LK3 to achieve 1802 microprocessor timing compatibility.

FIG. 8C shows the data entry switch means 178. The preferred embodiment of the switch means 178 includes six rotary BCD (binary coded decimal) switches 184, 186, 188, 190, 192 and 194 having their outputs connected to respective data bus buffer chips 196, 198 and 200 through which the electrical signals identifying the setting of the rotary BCD switches 184–194 are sent to the data bus 146. In the preferred embodiment the rotary BCD switches 184–194 generate binary coded decimal (BCD) signals which are read under software control. These switches are used to enter appropriate meter factors which relate to the specific type of input means to which the input signal conditioning board is connected. The meter factor is read by the microprocessor 130, and a corresponding correction factor is sent over the data bus 146 to the 8253 counters 158 and 160 to adjust the number of pulses counted from the signal provided by the amp and square circuit 156.

The pulse rate counting feature contained on the input signal conditioning board performs a calculation process which would otherwise have to be performed by the microprocessor 130. If the microprocessor 130 had to perform this calculation, it would be unable to handle a relatively large number of channels because the calculations would consume the microprocessor's time. Therefore, by utilizing the pulse rate counter means 154 on the input signal conditioning board, multichannel inputs can be handled by a single central processing unit board in each of the monitoring units 4–8. An example of this feature of the present invention will be described with reference to the specific embodiment of the counters shown in FIG. 11.

FIG. 11 discloses that each of the 8253 counter chips 158 and 160 includes three counters designated in the drawing by CNTR0, CNTR1, and CNTR2. CNTR0, CNTR1, and CNTR2 of the counter 160 are interconnected as shown in FIG. 11 and are controlled by microprocessor 130 and the amp and square circuit 156 to provide a number $N_1$ which is used by the microprocessor 130 to calculate a rate value of the monitored condition. CNTR2 of the counter 158 is used as a low rate detecting means to disable CNTR2 of the counter 160 whenever the signal from the amp and square circuit 156 is less than approximately 10 Hz. for the preferred embodiment of the present invention. CNTR0 and CNTR1 of the counter 158 operate to provide a value $N_2$ to the microprocessor for use thereby in calculating a volume.

In the preferred embodiment $N_1$ is obtained by presetting CNTR0 of the counter 160 with a predetermined count so that a gating disable signal is sent to CNTR1 of the counter 160 after thirty-two pulses have been received by CNTR0 from the amp and square circuit 156. As CNTR0 of the counter 160 is receiving the thirty-two pulses, CNTR1 of the counter 160 is enabled and provides a count of 100-microsecond pulses generated by CNTR2 of the counter 160. In the preferred embodiment CNTR1 of the counter 160 counts the 100-microsecond clock pulses by decrementing a hexadecimal count of FFFF which is preset in CNTR1 by the microprocessor 130. The microprocessor 130 monitors the output of the CNTR1 of the counter 160 to determine when two consecutive sets of data output by CNTR1 are the same. When two consecutive sets of outputs are the same, the microprocessor 130 is programmed to detect that a 32-pulse period has been counted by the CNTR0 of the counter 160. The microprocessor 130 then reads the data from CNTR1 of the counter 160 and subtracts the data read from CNTR1 from the initial value FFFF to obtain $N_1$. The microprocessor 130 utilizes $N_1$ in the following equation (which is contained in an appropriate format in the program controlling the microprocessor 130) to determine the monitored rate:

$$\text{RATE} = \frac{(320000)\,(60)\,(10)}{(N_1)\,(FAC)}$$

The foregoing equation was derived as follows:

$t=1/f$, where $t$=period and $f$=frequency;

$32t=32/f=T$, where 32 designates the thirty-two pulses or time periods counted by CNTR0 of counter 160;

$32/f=T=(N_1)$ (100 microsec.), where $N_1$ is the number of 100-microsecond pulses counted by CNTR1 of the counter 160 during the time period during which CNTR0 was counting thirty-two pulses from the amp and square circuit 156;

$$f = \frac{320000}{N_1};$$

$$\text{RATE}\,\frac{(.1\ \text{Units})}{\text{Min}} = \frac{f(p/\text{min})60(\text{sec}/\text{min})}{FAC(p/\text{units})t/10\ (\text{units}/.1\ \text{units})}$$

In the foregoing equation, the parameter FAC represents the particular factor which is entered in the rotary BCD switches 184–194. The entered factor has an implied decimal point so that the resolution of the determined rate is tenths of units. It is to be noted that the rate determining process provided by CNTR0, CNTR1 and CNTR2 of the counter 160 is initiated by software strobe #2 as indicated in FIG. 11.

The low rate detecting means provided in the preferred embodiment by CNTR2 of the counter 158 is used to disable the actual rate determining means of the counter 160 whenever a signal having a frequency of less than approximately 10 Hz. is received from the amp and square circuit. CNTR2 of the counter 158 operates so that the hexadecimal number $500_{16}$ is loaded into CNTR2 of the counter 158 whenever the gate input thereof is strobed by a pulse from the amp and square circuit 156. Between successive pulses received from the amp and square circuit 156, CNTR2 is decremented by the 100-microsecond clocking signal from CNTR2 of the counter 160. Whenever the most significant byte of the hexadecimal number goes to zero, (thereby indicating that the frequency of the gating signal received from the amp and square circuit 156 is less than 10 Hz.), the output of CNTR2 of the counter 158 disables the gate of CNTR2 of the counter 160 thereby stopping the clocking of CNTR1 of the counter 160. The frequency below which the low rate detecting means disables the actual rate determining means can be changed by varying the value which is loaded into CNTR2 of the counter 158.

CNTR0 and CNTR1 of the counter 158 are used to determine a value $N_2$ which is utilized by the microprocessor 130 in the following equation:

$$\text{VOLUME} = \text{PREVIOUS VOLUME} + N_2 + \frac{[(N_2)\,(\text{Error Factor}) + \text{Previous Remainder}]}{65536}$$

CNTR0 of the counter 158 is loaded with the respective factor which is entered in the microprocessor 130 by means of the rotary BCD switches 184–194. The entered factor has an implied decimal point, but the microprocessor 130 rounds the factor to the next highest whole number if there is a non-zero number in the tenths position. CNTR0 uses the loaded whole-number factor as a divisor to divide the number of pulses received by CNTR0 from the amp and square circuit 156. The output from CNTR0 is applied to the clock input of CNTR1 of the counter 158 which decrements CNTR1. $N_2$, an incremental volume used in the preceding volume formula, is determined by subtracting the current value of CNTR1 from the previous value of CNTR1.

To compensate for the rounding off of the entered factor, the microprocessor 130 generates an error factor according to the following formula:

$$\text{ERROR FACTOR} = \frac{(10 - Y)\,(65536)}{XXXXXY},$$

where XXXXXY is the factor entered in the rotary BCD switches and Y is the tenths digit of the factor.

It is to be noted that the embodiment just described with reference to FIG. 11 can be modified, such as by changing the interconnections between the constituent counters of the counter chips 158 and 160 or by changing the predetermined values entered into the counters. This ability to vary the configurations in which the chips 158 and 160 can be used provides flexibility to the input signal conditioning means 42.

FIGS. 9A–9C show the circuit contained on each of the printed circuit boards identified in FIGS. 3–6 as comprising the keyboard interfaces. Each of these boards receives an input signal from a sixteen-function keyboard or data entry means and transfers it as a four-bit priority word to the microprocessor 130 via the data bus 146. Therefore, the keyboard interface boards and their associated keyboards act as priority control means to command the microprocessor 130 to do specified functions, such as canceling prior commands or entering data.

FIG. 9A shows that each of the sixteen signals is received over a respective line. Eight of the signals, designated by the reference numeral 201, are debounced by transmitting them through shift registers 202 and 204. In the preferred embodiment these eight signals have the lowest priority. Another four signals, identified by the reference numeral 205, are transferred through the shift register 204 to a strappable connector 206 which may be strapped either to transfer a debounced signal to a priority encoder means 208 or to transfer the undebounced priority signal directly to the priority encoder 208. The remaining four keyboard signals, labeled with the reference numeral 209, are transferred directly to the priority encoder 208.

The eight lowest priority signals 201 are transmitted either to respective integrated circuit latches 210 or directly to a second priority encoder chip 212. This is achieved by strapping respective ones of connectors 214 shown in FIG. 9C.

The two priority encoders 208 and 212 provide four-bit outputs which are connected to logic gate means 216 shown in FIG. 9B. The logic gate means 216 includes a four-bit latch 218 which transfers the indicated signals to a data bus buffer (not shown).

When valid information has been received by the priority encoders 208 and 212, a valid information bit latch 220 is set. The output from the valid information latch 220 can be sent off the priority interrupt board, over the data bus, or as an interrupt over the standard bus as selected by appropriately strapping strappable connector means 222. When valid information has been received, the latch 220 is set and the four-bit priority encoded number is sent over the data bus 146. The four-bit priority number designates the active channel.

FIG. 10 discloses means for generating a timing signal to control the serial input/output means. In the preferred embodiment each serial input/output means shown in FIGS. 3–6 includes a universal asynchronous receiver transmitter unit (UART) as is known in the art for asynchronously, serially transmitting and receiving data. For the UART to properly function a receive and transmit clock signal must be provided thereto. This is provided by the timing means disclosed in FIG. 10.

The serial input/output timing means includes a sixteen-frequency generator means 224. In the preferred embodiment this is a model 14411 integrated circuit chip having two inputs which can be controlled to select one of four sixteen-frequency ranges. In the preferred embodiment these inputs are strappable to ground by means of strappable connector 226. A crystal 228 provides a 1.8432 MHz time base in the preferred embodiment.

The respective outputs from the frequency generator 224 are connected to respective ones of the sixteen inputs of a suitable integrated circuit demultiplexer means 230. In FIG. 10 the demultiplexer 230 is a model 4067 integrated circuit. So that one of the sixteen inputs can be selectively electrically connected to the output of the demultiplexer means 230, the demultiplexer 230 has a four-bit channel select input which is connected to a four-bit integrated circuit latch means 232 operating under software control from the microprocessor 130. Thus, to select a desired frequency at which the UART is to operate, the microprocessor 130 sends over the data bus 146 to the latch 232 the appropriate four-bit address. This address is conveyed to the demultiplexer 230 to select the respective input and transfer it to the output of the demultiplexer 230 and on to the UART. Therefore, for the configuration shown in FIG. 10, any one of sixty-four frequencies can be selected by manually applying the appropriate strap or straps to the connector 226 associated with the frequency generator 224 and by sending the appropriate software-controlled address to the latch 232.

To permit the microprocessor to readily access input and output channels, the monitoring units include the 32-channel bidirectional circuit cards. Each of the 32-channel bidirectional printed circuit boards includes two three-line-to-eight-line multiplexers which respond to three of the address lines of the address bus to provide two sets of active outputs. One of the two active outputs is selected by two additional address lines of the address bus. In this way thirty-two individual channels can be selected. This selection technique is used to address the various displays and data entry means shown connected to the 32-channel bidirectional boards shown in FIGS. 4, 5 and 6.

The visual displays of the output means depicted in FIGS. 4–6 include appropriate lamps such as light emitting diodes. The lamps are driven by appropriate lamp drivers and decoding means as is known in the art. For example, each digit can be driven by a 4511 binary-coded-decimal-to-seven-segment decoder/driver and each digit within a cluster of digits can be selected by an appropriate three-line-to-eight-line multiplexer. To insure that each lamp is properly functioning, the printed circuit boards on which the lamp drivers are located include a lamp test switch. Also included on these boards is a switch for enabling a software reset signal to reset the system.

Each serial input/output means includes the previously mentioned universal asynchronous receiver-transmitter means. In the preferred embodiment a model 1854 UART is used; however, other types may also be used. This device provides a data available signal, an interrupt signal, and a transmit holding register empty. Any one of these three signals can be strapped in the present invention to provide an interrupt to the microprocessor 130 over the standard bus interrupt line.

Although specific types, models and values of circuit components have been given in the preceding description and in the accompanying drawings, other models and values can be utilized and yet remain within the scope of the present invention.

During the operation of the present invention each of the monitoring units 4, 6 and 8 functions independently of the other monitoring units. This independent operation is controlled by the respective central processing unit board which is associated with each monitoring unit as illustrated in FIGS. 4–6. As each of the transducers of the input means detects the respective condition which it is monitoring, it converts the detected condition into a proportional electrical signal which is passed through the input signal conditioning means to the microprocessor and memory for further processing. After the detected signal is manipulated by the microprocessor into the desired format it is output via the 32-channel bidirectional board and the data bus to the respective display unit located on a respective one of the consoles illustrated in FIG. 2.

When output is desired to be recorded on a strip chart, the signal is placed on the data bus and the analog board is activated to cause the signal to be conveyed to the strip chart recorder.

When communication with the master communication control unit or with one of the other monitoring units is desired, an appropriate tranmission is made via the serial input/output board to the master communication control unit.

In this way, each of the physical parameters which is to be monitored is processed and displayed on the appropriate console for the control operator to see.

Thus, the present invention is well adapted to carry out the objects and attain the ends and advantages mentioned above as well as those inherent therein. While a preferred embodiment of the invention has been described for the purpose of this disclosure, numerous changes in the construction and the arrangement of parts can be made by those skilled in the art, which changes are encompassed within the spirit of this invention which is defined by the appended claims.

What is claimed is:

1. A system for monitoring a plurality of operations, comprising:

first input means for detecting a first physical condition identified with a first operation of said plurality of operations and for converting said first condition into a first electrical input signal;

first microcomputer means, responsive to said first electrical input signal, for producing a first output signal electrically representing information about said first physical condition, said first microcomputer means including:

first electronic microprocessor means;

first electronic memory means;

first input signal conditioning means for transforming said first electrical input signal into a digital signal usable by said first microprocessor means;

first priority control means for establishing priority control commands for said first microprocessor means; and first bus means for providing communication links between said first microprocessor means, said first memory means, said first input signal conditioning means and said first priority control means;

first output means for displaying said first output signal in a humanly understandable form;

second input means for detecting a second physical condition identified with a second operation of said plurality of operations and for converting said second condition into a second electrical input signal;

second microcomputer means, responsive to said second electrical input signal, for producing a second output signal electrically representing information about said second physical condition, said second microcomputer means including:

second electronic microprocessor means;

second electronic memory means;

second input signal conditioning means for transforming said second electrical input signal into a digital signal usable by said second microprocessor means;

second priority control means for establishing priority control commands for said second microprocessor means; and second bus means for providing communication links between said second microprocessor means, said second memory means, said second input signal conditioning means and said second priority control means;

second output means for displaying said second output signal in a humanly understandable form;

master microcomputer means for handling information transfers between said first and second microcomputer means; and communication interface means for providing a first communication path between said master microcomputer means and said first microcomputer means and for providing a second communication path between said master microcomputer means and said second microcomputer means.

2. A system as defined in claim 1, wherein each of said first and second microcomputer means further includes logic gate means for interfacing the respective microprocessor means with a respective microterminal means for entering information into, and displaying information from, the respective microcomputer means.

3. A system as defined in claim 2, wherein each of said first and second microcomputer means further includes:
a rack for holding printed circuit cards; and
a printed circuit board, mountable in said rack, having the respective microprocessor means and the respective logic gate means contained thereon.

4. A system as defined in claim 2, wherein:
said electronic microprocessor means includes a $\overline{\text{CLEAR}}$ input and a $\overline{\text{WAIT}}$ input;
said microterminal includes a TPB control terminal, a $\overline{\text{RUNU}}$ control terminal and a $\overline{\text{RUNP}}$ control terminal;
said bus means includes a $\overline{\text{PBRESET}}$ line, a $\overline{\text{WAITRQ}}$ line and a $\overline{\text{BUSRQ}}$ line; and
said logic gate means includes:
first combinational logic gate means having inputs electrically connectable to respective ones of said TPB, $\overline{\text{RUNU}}$ and $\overline{\text{RUNP}}$ control terminals and providing a latched output; and
second combinational logic gate means, including:
a plurality of inputs, one of said inputs for receiving the signal from the latched output of said first combinational logic gate means, another of said inputs for receiving a signal from said $\overline{\text{PBRESET}}$ line, a further one of said inputs for receiving a signal from said $\overline{\text{WAITRQ}}$ line and an additional one of said inputs for receiving a signal from said $\overline{\text{BUSRQ}}$ line;
a first output connected to said $\overline{\text{CLEAR}}$ input; and
a second output connected to said $\overline{\text{WAIT}}$ input.

5. A system as defined in claim 4, wherein each of said microprocessor means includes an RCA 1802 CMOS integrated circuit central processing unit.

6. A system as defined in claim 5, wherein each of said first and second microcomputer means further includes:
a rack for holding printed circuit cards; and
a printed circuit board, mountable in said rack, having the respective microprocessor means and the respective logic gate means contained thereon.

7. A system as defined in claim 1, wherein said input signal conditioning means includes:
means for changing the respective electrical input signal into an electrical signal having digitally recognizable pulses;
counter means for counting the number of said pulses;
adjustable means for adjusting the count of said pulses; and
time base means for providing an electrical timing signal.

8. A system as defined in claim 7, wherein said counter means includes:
a plurality of integrated circuit logic gates; and
means for interconnecting selectable ones of said logic gates so that different counting configurations can be manually constructed.

9. A system as defined in claim 8, wherein said adjustment means includes:
switch means for setting a predetermined numerical factor correlated to the respective input means; and
software-controlled means for entering said predetermined factor in said counter means so that the count of said pulses is adjusted.

10. A system as defined in claim 7, wherein said adjustment means includes:
switch means for setting a predetermined numerical factor correlated to the respective input means; and
software-controlled means for entering said predetermined factor in said counter means so that the count of said pulses is adjusted.

11. A system as defined in claim 1, wherein said priority control means includes:
data entry means for providing electrical signals representing desired priorities;
debounce circuit means for stabilizing at least a portion of the electrical signals; and
priority encoder means for detecting said electrical signals and for establishing a priority signal in response thereto.

12. A system as defined in claim 11, wherein:
said data entry means includes sixteen switch means;
said debounce circuit means includes twelve shift register integrated circuit means; and
said priority control means further includes:
means for electrically connecting eight of said sixteen switch means to eight of said twelve shift register integrated circuit means;
means for electrically connecting another four of said sixteen switch means to another four of said twelve shift register integrated circuit means; and
means for connecting the remaining four switch means to said priority encoder means.

13. A system as defined in claim 1, wherein said communication interface means includes:
means for asynchronously transmitting and receiving information between said master microcomputer means and said first and second microcomputer means; and
clocking means for providing an electrical timing signal having a selectable frequency.

14. A system as defined in claim 13, wherein said clocking means includes:
frequency generator means for providing a plurality of alternating electrical signals having frequencies within a manually selectable range; and
means, responsive to the respective microcomputer means with which said frequency generator means is associated, for selecting one of said plurality of alternating electrical signals within the manually selected range of frequencies.

15. A system for monitoring a plurality of conditions on an offshore drilling rig, comprising:
blender monitor means for monitoring the operation of blending materials for use at said offshore drilling rig, said blender monitor means including:
a plurality of blender transducers for converting transfers of blending material into proportionate electrical signals;
signal conditioning means for transforming the blender proportionate electrical signals into corresponding blender digital signals;
microprocessor means, responsive to said blender digital signals, for calculating blender output values electrically representing the detected conditions of the blending operation;
display means for visually displaying said blender output values; and
first serial transmitter and receiver means for serially transferring information from and to said blender monitoring means;
pumping monitor means for monitoring the operation of a plurality of pumps pumping substances at said offshore drilling rig, said pumping monitor means including:

a plurality of pumping transducers for converting physical pumping conditions into pumping proportionate electrical signals;

signal conditioning means for transforming the pumping proportionate signals into corresponding pumping digital signals;

microprocessor means, responsive to said pumping digital signals, for calculating pumping output values electrically representing the detected conditions of the pumping operations;

display means for visually displaying said pumping output means; and second serial transmitter and receiver means for serially transferring information from and to said pumping monitor means;

cementing monitor means for monitoring the operation of cementing a well drilled at said offshore drilling rig, said operation of cementing including utilizing cementing pumps for pumping cementing materials to the well, and said cementing monitor means including:

a plurality of cementing transducers for converting physical cementing conditions into cementing proportionate electrical signals;

signal conditioning means for transforming the cementing proportionate electrical signals into corresponding cementing digital signals;

microprocessor means, responsive to said cementing digital signals, for calculating cementing output values electrically representing the detected conditions of the cementing operation;

display means for visually displaying said cementing output values; and third serial transmitter and receiver means for serially transferring information from and to said cementing monitor means; and master communication control means for handling information transfers between said blender, pumping and cementing monitor means, including:

master microcomputer means;

fourth serial transmitter and receiver means communicationally linked with said first serial transmitter and receiver means, for serially transferring information between said master microcomputer means and said blender monitor means;

fifth serial transmitter and receiver means, communicationally linked with said second serial transmitter and receiver means, for serially transferring information between said master microcomputer means and said pumping monitor means; and sixth serial transmitter and receiver means communicationally linked with said third serial transmitter and receiver means, for serially transferring information between said master microcomputer means and said cementing monitor means.

16. A system as defined in claim 15, wherein each of said blender monitor means, pumping monitor means, and cementing monitor means further includes 32-channel bidirectional communication interface means for accessing a part of the respective display means to which a respective output value is to be sent.

17. A system as defined in claim 16, wherein:

said blender monitor means further includes switch means, associated with said 32-channel bidirectional communication interface means of said blender monitor means, for manually entering data into said blender monitor means;

said pumping monitor means includes means, responsive to said pumping microprocessor means, for deactivating selectable ones of said pumps; and said cementing monitor means includes:

switch means, associated with the 32-channel bidirectional communication interface means of said cementing monitor means, for manually entering data into said cementing monitor means; and means, responsive to said cementing microprocessor means, for deactivating selectable ones of said cementing pumps.

18. A system as defined in claim 17, further comprising:

an enclosure having said signal conditioning means, said microprocessor means, said display means, said serial transmitter and receiver means, said 32-channel bidirectional communication interface means, and said switch means contained therein; and a portable skid having said enclosure mounted thereon.

19. A system as defined in claim 18, wherein said enclosure includes means for purging air in said enclosure.

20. An apparatus for monitoring a plurality of operations, comprising:

first input means for detecting a first physical condition identified with an operation of blending chemicals wherein a blended substance is obtained for use at an offshore drilling rig and for converting said detected first physical condition into a first electrical input signal;

first microcomputer means, responsive to said first electrical input signal, for producing a first output signal electrically representing information about said detected first physical condition;

first output means for displaying said first output signal in a humanly understandable form;

second input means for detecting a second physical condition identified with an operation of pumping materials at said offshore drilling rig and for converting said detected second physical condition into a second electrical input signal;

second microcomputer means, responsive to said second electrical input signal, for producing a second output signal electrically representing information about said detected second physical condition;

second output means for displaying said second output signal in a humanly understandable form;

third input means for detecting a third physical condition identified with an operation of cementing a well at said offshore drilling rig and for converting said detected third physical condition into a third electrical input signal;

third microcomputer means, responsive to said third electrical input signal, for producing a third output signal electrically representing information about said detected third physical condition;

third output means for displaying said third output signal in a humanly understandable form; and master microcomputer means for handling information transfers between said first, second and third microcomputer means.

* * * * *